US007374854B2

(12) United States Patent
Ninomiya et al.

(10) Patent No.: US 7,374,854 B2
(45) Date of Patent: May 20, 2008

(54) IMAGE-FORMING METHOD AND IMAGE-FORMING APPARATUS USING THE SAME

(75) Inventors: Masanobu Ninomiya, Minamiashigara (JP); Hiroshi Nakazawa, Minamiashigara (JP); Takao Ishiyama, Minamiashigara (JP); Toshiyuki Yano, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 314 days.

(21) Appl. No.: 11/227,226

(22) Filed: Sep. 16, 2005

(65) Prior Publication Data

US 2006/0216630 A1 Sep. 28, 2006

(30) Foreign Application Priority Data

Mar. 24, 2005 (JP) ..... 2005-087299

(51) Int. Cl.
*G03G 13/04* (2006.01)
*G03G 15/04* (2006.01)

(52) U.S. Cl. ..... 430/123.4; 430/110.4; 399/118; 399/122; 399/181; 399/320

(58) Field of Classification Search ..... 430/123.4, 430/110.4; 399/118, 122, 181, 320
See application file for complete search history.

(56) References Cited

U.S. PATENT DOCUMENTS

| | | | | |
|---|---|---|---|---|
| 6,438,274 | B1 * | 8/2002 | Tokuyama et al. | 382/298 |
| 6,549,657 | B2 * | 4/2003 | Ohta et al. | 382/173 |
| 6,608,941 | B1 * | 8/2003 | Suzuki et al. | 382/272 |
| 2004/0051902 | A1 * | 3/2004 | Sasaki | 358/2.1 |

FOREIGN PATENT DOCUMENTS

| | | |
|---|---|---|
| JP | B2 04-24702 | 4/1992 |
| JP | A 08-234480 | 9/1996 |
| JP | A 09-325520 | 12/1997 |
| JP | A 10-123748 | 5/1998 |
| JP | A 2003-189103 | 7/2003 |
| JP | A 2004-001260 | 1/2004 |

* cited by examiner

*Primary Examiner*—Hoa Van Le
(74) *Attorney, Agent, or Firm*—Oliff & Berridge, PLC

(57) ABSTRACT

The present invention provides an image-forming method, including pseudo-halftone-processing an input signal corresponding to image information to generate an output signal; irradiating a radiation beam corresponding to the output signal onto a latent image-holding member to form a latent image; developing the latent image with a developer including a toner containing a binder resin and a colorant to form a toner image on the latent image-holding member; transferring the toner image onto a recording medium; and fixing the toner image on the recording medium to form an image, wherein: when a halftone image is formed as the image, the toner image formed on the latent image-holding member is composed of plural toner aggregates scattered like dots on the latent image-holding member; the diameter of the radiation beam irradiated onto the latent image-holding member is 35 μm or more; the pseudo-halftone processing results in the toner aggregates, which have been transferred onto the recording medium, having uneven sizes; and the toner satisfies the following Formulae (1) and (2):

$$2.0\times10^5 \leqq G'(60) \leqq 4.0\times10^6 \quad \text{Formula (1)}$$

$$G'(60)/G'(80) \leqq 40 \quad \text{Formula (2)}$$

wherein G'(60) represents the storage modulus (Pa) of the toner as determined under conditions of a temperature of 60° C., a vibration frequency of 6.28 rad/sec, and a distortion factor of 0.1%; and G'(80) represents the storage modulus (Pa) of the toner as determined under conditions of a temperature of 80° C., a vibration frequency of 6.28 rad/sec, and a distortion factor of 0.1%.

10 Claims, 3 Drawing Sheets

IMAGE-FORMING METHOD AND IMAGE-FORMING APPARATUS USING THE SAME

CROSS-REFERENCE TO RELATED APPLICATION

This application claims priority under 35 U.S.C. 119 from Japanese Patent Application No. 2005-87299, the disclosure of which is incorporated by reference herein.

BACKGROUND OF THE INVENTION

1. Field of the Invention

The invention relates to an electrophotographic image-forming method and an image-forming apparatus using the same.

2. Description of the Related Art

Electrophotographic methods have been commonly used in forming images in, for example, copying machines and laser beam printers. Developers known for use in electrophotographic methods include two-component developers containing toner and carrier particles and one-component developers containing only magnetic or nonmagnetic toner particles. The toner particles contained in such developers are usually produced by a kneading and pulverizing process.

In the kneading and pulverizing process, desired toner particles are produced by melt-kneading a resin such as a thermoplastic resin, a pigment, a charge control agent, and a releasing agent such as wax, cooling the resultant mixture, pulverizing the mixture into fine particles, and classifying the fine particles. In order to improve the flowability and the cleaning property of the toner, particles prepared in the kneading and pulverizing process are used as mother particles, and inorganic and/or organic fine particles are adhered to the surfaces of the mother particles, and the resulting particles are used as toner particles in some cases.

In the electrophotographic image-forming method, an electrostatic latent image formed on a latent image-holding member by an optical unit is developed with a developer in a developing step, giving a toner image. The toner image is transferred onto a recording medium such as recording paper in a transferring step, and the transferred toner image is finally fixed on the recording medium generally by application of heat and pressure in a fixing step.

Recently, electrophotographic technology has advanced rapidly from black and white technology to full-color technology. In a full-color electrophotographic imaging method, a full-color image is generally produced by using four color toners, one in black and three in three primary colors: yellow, magenta, and cyan.

Generally in the full-color electrophotographic imaging method, an original image is first subjected to color separation to obtain yellow image information, magenta image information, cyan image information, and black image information. An electrostatic latent image is formed on a photoconductive layer according to one image information, and the electrostatic latent image is then developed to give a toner image. The series of processes are repeated for the respective colors. The resultant toner images of different colors are aligned and superimposed on a recording medium so that the resulting full-color image coincides with the original image. The full-color image is then fixed on the recording medium.

The color toners used in the full-color electrophotographic imaging method should be mixed thoroughly in the fixing step. In this way, it is possible to improve color reproducibility and transparency of overhead projector (OHP) images and obtain full-color images having superior image quality. To improve color-mixing property, a low-molecular weight resin having a narrow melting temperature range is often used in the color toner.

To cope with the trend toward energy conservation, various toners having an improved low-temperature fixing property have been proposed (e.g., Japanese Patent Application Laid-Open (JP-A) Nos. 9-325520, and 8-234480, and Japanese Patent Application Publication (JP-B) No. 4-24702). In particular, toners having a so-called core-shell structure, which have a core layer and a shell layer coating the core layer, can be superior in low temperature-fixing property (e.g., JP-B No. 4-24702). These toners generally have a melting temperature range narrower than that of other conventional toners to improve the color-mixing property in a low temperature-fixing step.

On the other hand, in an image-forming apparatus implementing an electrophotographic method, input image information is converted to an input signal by, for example, a scanner, and the input signal is then subjected to various image processings such as filtering and pseudo-halftone processing in the image-processor, finally giving an output signal. Subsequently, an electrostatic latent image is formed according to the output signal.

When the input image information is a pictorial image such as photograph, a datum for one pixel is a multivalued datum. In contrast, in an image-forming apparatus forming an image on a recording medium such as recording paper, the number of gradations expressed per pixel is substantially much smaller.

To solve the nonconformance between the datum and the number of the gradations per pixel, such an image-forming apparatus employs a method of forming a so-called pseudo-halftone image. In the method, each pixel is divided into plural sub-pixels to improve resolution, and image density in each sub-pixel is expressed by an area modulation method. Pseudo-halftone processing is the image processing performed in the step of converting an input signal to a pseudo-halftone image.

Pseudo-halftone processing enables an image-forming apparatus having a small number of displayable gradations per pixel to handle one-pixel data which are multivalued data and to form an image such as a full-color image therefrom. The pseudo-halftone processing can generally be divided into AM screening and FM screening.

Typically, AM screening is a dither method of expressing a halftone image by forming dots that are aligned at a certain pitch and changing the sizes of the dots, while FM screening is an error diffusion method of expressing a halftone image by changing the density of the dots.

Generally, AM screening or FM screening is selected and designed as appropriate for improvement in the graininess of a halftone image. AM screening has been used in electrophotographic methods for a long time. However, AM screening has often resulted in generation of output moire and a noticeable hexagonal rosette pattern in highlights and halftone portions, and noticeable density jump even at an area rate of approximately 50%, because dots are formed in the above-described manner. To solve these problems regarding image quality, use of FM screening was proposed (JP-A Nos. 2003-189103 and 2004-1260).

Recently, there has also been a need for power saving and improvement in image quality in electrophotography. To save power in electrophotographic methods and specifically, to reduce the energy consumption needed during operation of the device, there is a need for low temperature image fixing. For reduction of the energy consumption during stand-by periods, apparatuses are often used that have a function of reducing the power supply to the fixing unit and thus cooling the heater such as a heating roll to a temperature lower than that during fixing (hereinafter, referred to "power-saving function during stand-by period") when the stand-by mode where no image is formed is continued for a certain period.

To ensure efficiency of operation as well as power saving, it is preferable to use a fixing unit having a smaller heat capacity in apparatuses having such a function. This is because, when an apparatus containing a heater cooled to a temperature lower than that suitable for fixing by a decrease in energy supply to the heater in the fixing unit is reactivated to the state for image forming, it is desirable, from the viewpoint of efficiency, to heat the heater to a temperature suitable for fixing as soon as possible by increasing power supply.

However, when an image-forming apparatus containing such a fixing unit is reactivated, from the stand-by mode where the heater of the fixing unit is cooled to a temperature lower than the set fixing temperature of the heater to an image-forming mode, a great amount of electric energy is applied to the heater all at once to instantaneously heat the heater to the set fixing temperature, resulting in a phenomenon that the heater temporarily overheats to a temperature higher than the set fixing temperature (overshoot). Such an overshoot immediately after resumption of image forming is called "initial overshoot". When paper is fed into the fixing unit for image formation during overshoot, the paper in the fixing unit absorbs the heat of the heater and chills the fixing unit to a temperature lower than the temperature elevated by the overshoot.

When images are formed successively, the decrease in the temperature of fixing unit by paper supply, and the increase thereof by heating when the fixing unit has cooled to a temperature lower than a predetermined temperature, occur periodically, causing periodic overshoot (hereinafter, referred to as "periodic overshoot").

Such an overshoot may cause offsetting when it is significant or when it is not significant but a particular toner is used in the apparatus. In particular, when the offsetting occurs at high temperature, the offsetting becomes more obvious in areas where a halftone image is formed than in areas where a solid image is formed (hereinafter, offsetting of the halftone image is referred to as "halftone offsetting").

On the other hand, when an image is formed with a conventional toner having superior low-temperature fixing property and a narrow melting temperature range, increase in the temperature of the fixing unit during fixing tends to cause halftone offsetting more frequently.

Thus, there is a need for an image-forming method that allows low-temperature fixing and suppresses halftone offsetting even at a high fixing temperature and an image-forming apparatus using the same.

SUMMARY OF THE INVENTION

To satisfy the above need, the inventors have studied the causes of the halftone offsetting occurring more frequently when a toner having a narrow melting temperature range is used. Thus, in their examination, they paid particular attention to a method of forming halftone images (excluding halftone images close to solid images).

An electrostatic latent image is first formed on a latent image-holding member surface by irradiation thereon of light in the form of dots of dozens μm in diameter according to the output signal obtained by pseudo-halftone processing. The area irradiated in the dot pattern is then developed selectively, giving a halftone toner image.

Unlike the case where a solid image or a halftone image close to a solid image is formed, a halftone toner image is not an image where the latent image-holding member surface is entirely covered with toner particles, but is an image composed of toner aggregates which are formed by adhesion of toner particles covering the area irradiated in the dot pattern, and which are scattered like dots on the latent image-holding member surface.

Then, after the transfer and fixing steps, a toner image composed of plural toner aggregates scattered like dots on the latent image-holding member surface is finally fixed on a recording medium such as recording paper, giving a halftone image.

In such a process, the transfer and fixation of the toner image for finally forming the halftone image may be regarded microscopically as a phenomenon of the combination of transfer and fixation of individual toner aggregates. The halftone image is an image expressed by converting the original image information into a dot pattern and also using an optical illusion. Thus, halftone offsetting is, strictly speaking, a phenomenon where offsetting is occurring not only in all toner aggregates but also in at least a certain proportion of the toner aggregates to an extent visually observable, among plural toner aggregates scattered like dots on the latent image-holding member surface.

For that reason, it may be said that, even when offsetting occurs in a part of the toner aggregates, it is practically possible to suppress halftone offsetting if the proportion is small.

Offsetting in individual toner aggregates depends on the adhesiveness of the toner aggregates to the recording medium during fixing, similarly to offsetting in a solid toner image. In the latter case, the toner image is continuous microscopically. Therefore, even if the adhesiveness decreases partially, offsetting does not occur. However, in the former case, the toner image is intermittent microscopically, and decrease in the adhesiveness immediately causes offsetting.

For that reason, the inventors considered that it would be important to (A) improve the adhesiveness of individual toner aggregates to the recording medium during fixing and (B) reduce the offsetting rate of toner aggregates, for prevention of the offsetting in individual toner aggregates and the halftone offsetting at the macroscopic level.

It is thought that the adhesiveness of the toner aggregates to the recording medium depends on the size of the toner aggregates (area thereof in the direction parallel to the recording medium surface) and the viscosity of the toner during fixing, which viscosity is selected in consideration of the fluctuation in fixing temperature due to overshoot of the device.

Thus, to improve the adhesiveness of the toner aggregates to the recording medium, it would be necessary to conduct exposure and development in such a way that toner aggregates having a large size are formed. In addition, it would be necessary to use a toner that gives viscosity ensuring sufficient adhesiveness in the fixing-temperature range fluctuated by overshoot of a fixing unit.

In addition, if the viscosity of the toner is constant, the adhesiveness of the toner seems to be proportional to the contact area during fixing. Therefore, in order to reduce the proportion of offset toner aggregates, it would be important for toner aggregates to have uneven sizes. Namely, it would be necessary to perform pseudo-halftone processing in such a way that the sizes of the toner aggregates become uneven during exposure and development.

In such a case, offsetting occurs in toner aggregates having a relatively small size but offsetting does not occur in toner aggregates having a relatively large size. Thus, if the rate of the toner aggregates where offsetting does not occur macroscopically is large, halftone offsetting would not be observed visually. Even if the fixing temperature is altered by overshoot in the fixing unit, offsetting does not occur in all toner aggregates all at once, only the proportion of toner aggregates resistant to offsetting changes. Therefore, it is possible to suppress the halftone offsetting due to overshoot.

Meanwhile, if the size of the toner aggregates is even, offsetting, if it happens, occurs in almost all toner aggregates all at once, consequently causing halftone offsetting.

Based on the findings described above, the inventors have completed the following invention.

A first aspect of the invention provides an image-forming method, including: pseudo-halftone-processing an input signal corresponding to image information to generate an output signal; irradiating a radiation beam corresponding to the output signal onto the surface of a latent image-holding member to form a latent image; developing the latent image with a developer including a toner containing a binder resin and a colorant to form a toner image on the surface of the latent image-holding member; transferring the toner image onto a recording medium; and fixing the toner image on the recording medium to form an image, wherein: when a halftone image is formed as the image, the toner image formed on the surface of the latent image-holding member by the pseudo-halftone processing is composed of a plurality of toner aggregates scattered like dots on the surface of the latent image-holding member; the diameter of the radiation beam irradiated onto the surface of the latent image-holding member is 35 μm or more; the pseudo-halftone processing results in the toner aggregates, which have been transferred onto the recording medium, having uneven sizes; and the toner satisfies the following Formulae (1) and (2):

$$2.0\times10^5 \leqq G'(60) \leqq 4.0\times10^6 \quad \text{Formula (1)}$$

$$G'(60)/G'(80) \leqq 40 \quad \text{Formula (2)}$$

wherein in Formulae (1) and (2), G'(60) represents the storage modulus (Pa) of the toner as determined under conditions of a temperature of 60° C., a vibration frequency of 6.28 rad/sec, and a distortion factor of 0.1%; and G'(80) represents the storage modulus (Pa) of the toner as determined under conditions of a temperature of 80° C., a vibration frequency of 6.28 rad/sec, and a distortion factor of 0.1%.

A second aspect of the invention provides a device for forming an image, having: a latent image-holding member; a pseudo-halftone processor for pseudo-halftone-processing an input signal corresponding to image information to generate an output signal; a latent image-forming unit for irradiating a radiation beam corresponding to the output signal to form a latent image on the surface of the latent image-holding member; a developing unit for developing the latent image with a developer including a toner containing a binder resin and a colorant to form a toner image on the surface of the latent image-holding member; a transfer unit for transferring the toner image onto a recording medium; and a fixing unit for fixing the toner image on the recording medium to form an image, wherein the image is formed by the image-forming method described above, and, when a halftone image is formed as the image, the toner image formed on the surface of the latent image-holding member by the pseudo-halftone processing is composed of a plurality of toner aggregates scattered like dots on the surface of the latent image-holding member.

As described above, the invention provides an image-forming method that allows low-temperature fixing and suppresses halftone offsetting even at a high fixing temperature, and an image-forming apparatus using the same.

DETAILED DESCRIPTION OF THE INVENTION

<Image-forming Method>

Figure 1:
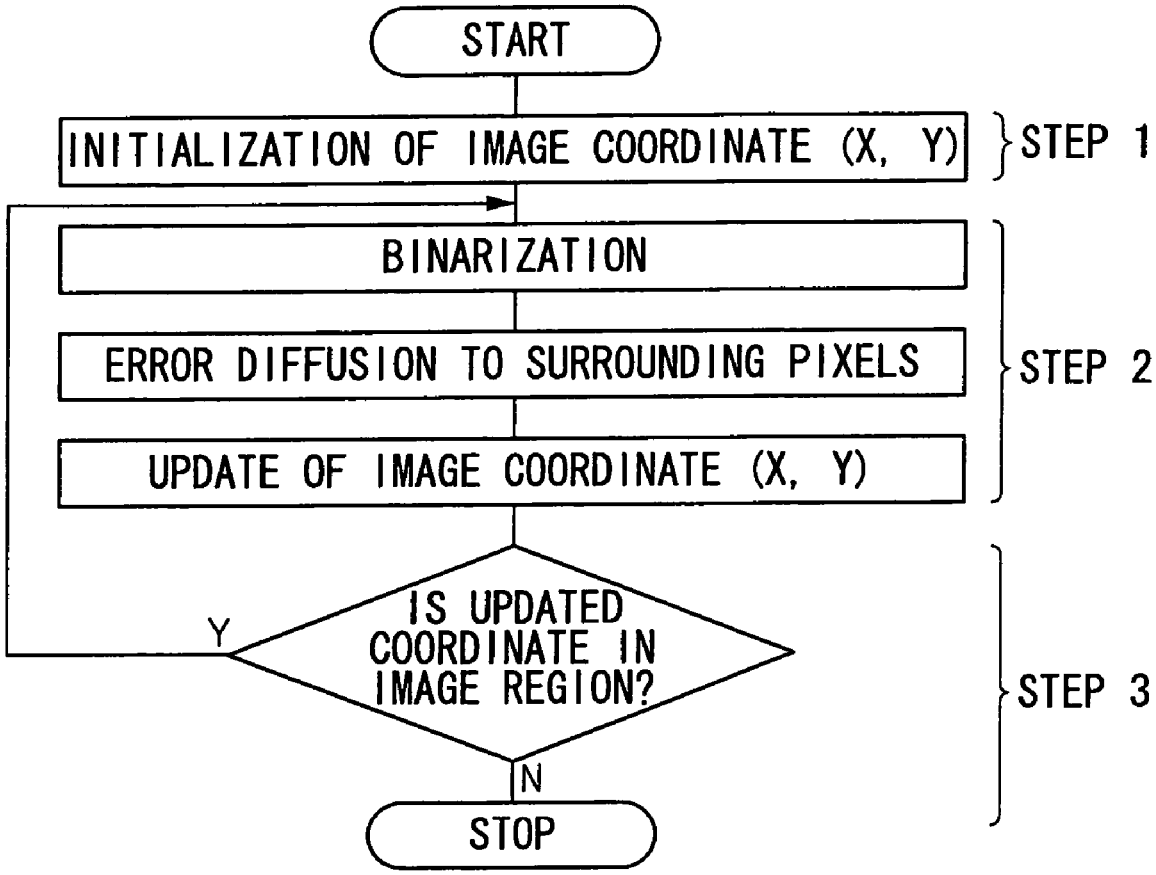
FIG. 1 is a flowchart showing the processing procedures in FM screening.

The image-forming method of to the invention includes: pseudo-halftone-processing an input signal corresponding to image information to generate an output signal; irradiating a radiation beam corresponding to the output signal onto the surface of a latent image-holding member to form a latent image; developing the latent image with a developer including a toner containing a binder resin and a colorant to form a toner image on the surface of the latent image-holding member; transferring the toner image onto a recording medium; and fixing the toner image on the recording medium to form an image, wherein: when a halftone image is formed as the image, the toner image formed on the surface of the latent image-holding member by the pseudo-halftone processing is composed of a plurality of toner aggregates scattered like dots on the surface of the latent image-holding member; the diameter of the radiation beam irradiated onto the surface of the latent image-holding member is 35 μm or more; the pseudo-halftone processing results in the toner aggregates, which have been transferred onto the recording medium, having uneven sizes; and the toner satisfies the following Formulae (1) and (2).

$$2.0\times10^5 \leqq G'(60) \leqq 4.0\times10^6 \quad \text{Formula (1)}$$

$$G'(60)/G'(80) \leqq 40 \quad \text{Formula (2)}$$

In Formulae (1) and (2), G'(60) represents the storage modulus (Pa) of the toner as determined under conditions of a temperature of 60° C., a vibration frequency of 6.28 rad/sec, and a distortion factor of 0.1%; and G'(80) represents the storage modulus (Pa) of the toner as determined under conditions of a temperature of 80° C., a vibration frequency of 6.28 rad/sec, and a distortion factor of 0.1%.

First in the invention, the diameter of the radiation beam irradiated onto the surface of the latent image-holding member should be 35 μm or more. A beam having a diameter of less than 35 μm leads to decreased size of the toner aggregates formed after the exposure and development steps and decreased contact area of the transferred toner aggregates to the recording medium. Therefore, sufficient adhesive strength, which is proportional to the contact area, between the toner aggregates and the recording medium cannot be obtained at the time of fixing.

Accordingly, even when pseudo-halftone processing, for example FM screening which can form regions where individual latent dots corresponding to individual radiation beams adjoin or overlap with each other and can form toner aggregates having a size larger than the size of each dot, is used in such a case, the size of the toner aggregates tends to decrease macroscopically, making it impossible to suppress halftone offsetting.

For that reason, the beam diameter is more preferably 40 μm or more and still more preferably 50 μm or more. However, an excessively large beam diameter results in deteriorated graininess, which may degrade image quality. Thus, the beam diameter is preferably 100 μm or less.

In the invention, the "beam diameter" means the width of a beam spot formed on the surface of the latent image-holding member, and more specifically, is the width of the beam having an intensity of $1/e^2$ (about 14%) with respect to the maximum value in the Gaussian distribution of beam intensity.

The second feature of the invention is that the pseudo-halftone processing should result in the toner aggregates, which have been transferred onto the recording medium, having uneven sizes in forming a halftone image. Thus, even if offsetting occurs in some toner aggregates, toner aggregates having a relatively large size have a large contact area and in turn sufficient adhesive strength, and thus do not result in offsetting. Therefore, it is possible to prevent halftone offsetting macroscopically. In addition, even when overshoot raises a fixing temperature and decreases toner viscosity, a large contact area between the toner and the recording medium can prevent the adhesive strength therebetween from decreasing, which can prevent halftone offsetting.

The size of the toner aggregates almost corresponds to that of the area of the latent image-holding member which area is irradiated with radiation beams. Thus, given the premise that beams have a constant diameter, the requirement of "the toner aggregates having uneven sizes" means that radiation beams are irradiated in such a way that regions where latent dots are completely isolated from each other and regions where latent dots are close to or overlap with each other are formed.

The latent dots "close to each other" are latent dots which are adjacently formed on the latent image-holding member, with a space therebetween. The space can be filled with toner aggregates which are deformed by pressure applied during transfer so that the latent dots bond together. Whether the sizes of the toner aggregates are uneven can be easily determined by observing a halftone toner image before fixing with, for example, an optical microscope.

Irradiation of radiation beams to make the sizes of toner aggregates uneven can be realized by selecting a suitable pseudo-halftone processing, and FM screening is preferably selected.

In the case of a pseudo-halftone processing which forms toner aggregates having an even size, or, in other words, in the case of irradiation of radiation beams to form latent dots separate from each other, when the device is left under conditions where offsetting occurs, the offsetting occurs in almost all toner aggregates, resulting in halftone offsetting. Such pseudo-halftone processing is, for example, AM screening which forms latent dots separate from each other.

Although beams irradiated have a constant size in ordinary image-forming methods, the sizes of the toner aggregates are uneven in the invention as aforementioned. In order to make the sizes of the toner aggregates uneven, a region corresponding to one pixel can be irradiated with plural radiation beams. In this case, radiation beams having different sizes can be used for irradiation. For example, radiation beams having a diameter of 35 μm and those having a diameter of 60 μm can be irradiated alternately. In addition, radiation beams having different diameters may be irradiated to form latent dots separate from each other and latent dots adjoining or overlapping with each other.

The third feature of the invention is that a toner satisfying Formulae (1) and (2) described above should be used. The toner satisfying Formulae (1) and (2) can have a low-temperature fixing property. Moreover, viscosity change during fixing due to overshoot can be suppressed in such a toner. Therefore, even when overshoot raises a fixing temperature, a decrease in viscosity can be prevented, suppressing a decrease in adhesive strength. Accordingly, even when halftone images are formed successively, halftone offsetting can be prevented.

The storage modulus of the toner for use in the invention is about $2.0\times10^5$ Pa to about $4.0\times10^6$ Pa at 60° C., and is preferably about $5.0\times10^5$ Pa to about $3.0\times10^6$ Pa at 60° C. Such a toner can be fixed at a low temperature. In the invention, the temperature of low-temperature fixing is about 90 to about 120° C., and is preferably about 100 to about 110° C.

When the storage modulus at 60° C. is less than $2.0\times10^5$ Pa, the toner has a low elasticity and deforms in the transferring step and thus fixing defects occur. When the storage modulus at 60° C. is higher than $4.0\times10^6$ Pa, the toner has a high elasticity, and is difficult to fix at a lower temperature.

In addition, the toner for use in the invention has a ratio of the storage modulus at 60° C., G'(60), to the storage modulus at 80° C., G'(80) (the ratio of G'(60)/G'(80)), of 40.0 or less. Therefore, halftone offsetting can be prevented, even when the influence of overshoot is significant, for example, when halftone images are formed successively after the image-forming device being in a stand-by mode.

The ratio of G'(60)/G'(80) is an indicator showing the degree of dependence of toner viscoelasticity on temperature. The higher the ratio of G'(60)/G'(80) is, the narrower the melting temperature range of the toner is. In other words, the lower the ratio is, the wider the melting temperature range is.

A toner having a ratio G'(60)/G'(80) of more than 40 results in generation of halftone offsetting, because the toner has an extremely high degree of dependence of toner viscoelasticity on temperature. In particular, when halftone images are formed successively after the image-forming device being in a stand-by mode, and when the halftone images are fixed at a fixing temperature raised by overshoot, halftone offsetting occurs extremely easily, and stable images cannot be obtained.

Accordingly, the ratio of G'(60)/G'(80) is preferably small, and specifically, is preferably 30 or smaller. However, a toner having an excessively small ratio of G'(60)/G'(80) may insufficiently melt and, when a full-color image is formed, color development may deteriorate. Therefore, the ratio of G'(60)/G'(80) is preferably 10 or more and more preferably 15 or more.

A toner with a so-called core-shell structure having a core layer containing a first binder resin and a colorant and a shell layer covering the surface of the core layer and containing a second binder resin is preferably used in the invention, because such a toner can easily satisfy Formulae (1) and (2).

In such a case, the tangent loss of the toner for use in the invention which tangent loss is measured at a vibration frequency of 6.28 rad/sec at a distortion factor of 0.1% preferably has two peaks (maximum values) in the temperature range of 30° C. to 90° C. The peak of tangent loss represents movement of the main chain of the binder resin contained in a toner. Tangent loss having two peaks indicates that two binder resins are incompatible with each other and are independently present in the toner.

A toner with a core-shell structure having two tangent loss peaks indicates that the two binder resins contained respectively in the core and shell layers are incompatible with each other and are independently present in the toner.

Such a toner having two tangent loss peaks in the range of 30° C. to 90° C. is preferably used, because the dependence of viscoelasticity of the toner on temperature (slope) can be so easily controlled as to satisfy the requirement represented by Formula (2).

A toner which contains two binder resins and has a single tangent loss peak in the range of 30° C. to 90° C. means that the two binder resins are compatible with each other in the toner. Therefore, changing, for example, the types of two binder resins compatible with each other results in toners having almost the same slope of dependence of viscoelasticity on temperature, and results in simply shifting the curve of viscoelasticity-temperature dependence. Thus, it is occasionally difficult to control dependence of viscoelasticity of the toner containing such two binder resins on temperature (slope) so that the toner satisfies the requirement represented by Formula (2).

In the invention, the storage modulus and the tangent loss (loss elastic modulus) are determined from the dynamic viscoelasticity of a toner measured in accordance with a sine wave oscillation method. ARES analyzer manufactured by Rheometric Scientific Inc. is used to measure the dynamic viscoelasticity.

The dynamic viscoelasticity is measured as follows. A toner is formed into a tablet and the tablet is placed between parallel plates having a diameter of 8 mm. After normal force is set to zero in the measuring device, sine wave vibrations are applied to the tablet at a vibration frequency of 6.28 rad/sec. The measurement is performed while the tablet is heated from 20° C. to 100° C. at a programming rate of 1° C./min. The measurement time interval is 30 seconds.

Before the measurement, the following procedure is conducted. While the amount of stress applied to the toner is changed, the distortion factor of the toner is measured in the temperature range of from 20° C. to 100° C. at an interval of 10° C. Thereby, the relationship between the stress and the distortion factor is obtained and the range of distortion factor where the amount of stress and the distortion factor have a linear relationship is determined at each temperature. In the measurement, the distortion factor at each measurement temperature is kept at 0.1% and the amount of stress and the distortion factor are so controlled as to have a linear relationship over the entire temperature range. The storage modulus and the tangent loss are calculated from the measurement results obtained.

In order to further suppress generation of halftone offsetting, an intermediate transfer member is preferably used in the transferring step. In other words, the transferring step preferably includes: transferring a toner image formed on the surface of the latent image-holding member onto the surface of the intermediate transfer member, and transferring the toner image transferred on the surface of the intermediate transfer member onto the surface of a recording medium.

In such a case, deformation of toner aggregates (so-called mechanical dot gain) occurs in transferring the toner aggregates formed on the surface of the latent image-holding member onto the surface of the intermediate transfer member and transferring the toner aggregates on the surface of the intermediate transfer member onto the recording medium. Therefore, when the distance between adjacent toner aggregates on the latent image-holding member surface is short, the distance between adjacent toner aggregates transferred onto the recording medium becomes shorter and the adjacent toner aggregates easily bond together, further suppressing halftone offsetting.

Next, a method for producing the toner and the components thereof for use in the invention will be described. The method for producing the toner for use in the invention is not particularly limited and any known method may be conducted. However, a wet production method, particularly an emulsion polymerization aggregation method, is preferably conducted from the viewpoint of easiness in producing a toner having a core-shell structure that easily satisfies the requirements represented by Formulae (1) and (2).

In such a case, the method of producing the toner used in the invention preferably includes an aggregation step of adding a coagulant to a mixed dispersion liquid containing a first resin fine particle dispersion liquid which contains first resin fine particles made of a first binder resin and having a volume-average diameter of 1 μm or less, and a colorant dispersion liquid containing a colorant (colorant particles), and heating the resultant mixture to form a dispersion liquid containing core particles; an adhesion step of adding a second resin fine particle dispersion liquid containing second resin fine particles made of a second binder resin and having a volume-average diameter of 1 μm or less to the dispersion liquid containing core particles to adhere the second resin fine particles onto the surfaces of the core particles and to form resin-adhered agglomerates; and a coalescence step of fusing the resin-adhered agglomerates.

In the aggregation step, the core particles may be those obtained by simply aggregating various fine particle components contained in the mixed dispersion liquid (core agglomerates), or those obtained by heating the particle components to a temperature higher than the glass transition temperature of the first binder resin to simultaneously aggregate and fuse the components (core fused particles). The coalescence step may be conducted by heating the agglomerates to a temperature equal to or higher than the glass transition temperature of each of the first and second binder resins. When the resin-adhered agglomerates are obtained from the core fused particles, the agglomerates may be fused with mechanical stress. These steps will be described later in detail.

In addition to having the core-shell structure formed through the steps described above, the toner for use in the invention may contain a releasing agent and/or any other additive and may have an external additive such as a flowability-improving aid.

Hereinafter, components of the toner used in the invention will be described in more detail, taking into account the toner having a core-shell structure and being produced in accordance with the aforementioned emulsion polymerization aggregation method. However, the materials described below may also be used to prepare a toner which does not have a core-shell structure or which is prepared in accordance with other manufacturing method.

First Binder Resin (Binder Resin for Core Layer)

Any of known amorphous or crystalline resins may be used as the first binder resin for use in the invention (hereinafter, referred to as a "binder resin for a core layer" or "core layer binder resin"). When the resin is an amorphous resin, the following material may be used as the resin.

Examples of the amorphous resin include homopolymers made from monomers, including styrenes such as styrene, p-chlorostyrene, and α-methylstyrene, vinyl group-containing esters such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, and 2-ethylhexyl methacrylate, vinyl nitrites such as acrylonitrile and methacrylonitrile, vinyl ethers such as vinyl methyl ether and vinyl isobutyl ether, and vinyl ketones such as vinyl methyl ketone, vinyl ethyl ketone, and vinyl isopropenyl ketone, and olefins such as ethylene, propylene, and butadiene; copolymers of two or more of the monomers described above; and mixtures of two or more of these homopolymers and copolymers.

Alternatively, a non-vinyl condensation resin or resins such as an epoxy resin, a polyester resin, a polyurethane resin, a polyamide resin, a cellulose resin, or a polyether resin can be used as the first binder resin. Moreover, a mixture of two or more of these resins and vinyl resins made from the vinyl monomers described above, or a graft polymer obtained by polymerizing a vinyl monomer in the presence of one or more of the resins described above can also be used.

One of these resins may be used alone or two or more of them can be used together.

When a vinyl monomer is used to prepare the first binder resin, a resin fine particle dispersion liquid can be prepared by conducting emulsion polymerization or seed polymerization in the presence of an ionic surfactant or other agent. When other resin is used as the first binder resin, a desired resin fine particle dispersion liquid can be prepared by dissolving the resin in an oily solvent having a relatively low solubility in water, dispersing the resultant solution in water in the presence of an ionic surfactant and/or a polyelectrolyte with a dispersing machine such as a homogenizer to prepare fine particles dispersed in water, and then removing the solvent by heating or at a reduced pressure.

Fine particles of a thermoplastic binder resin whose monomer(s) include a dissociative vinyl monomer can be stably prepared as particles obtained by, for example, emulsion polymerization.

Examples of the dissociative vinyl monomer include raw materials for polymeric acids such as acrylic acid, methacrylic acid, maleic acid, cinnamic acid, fumaric acid, vinylsulfonic acid and those for polymeric bases such as ethyleneimine, vinylpyridine, and vinylamine. The dissociative vinyl monomer is preferably a raw material for a polymeric acid from the viewpoint of easiness in polymer-forming reaction. In particular, a carboxyl group-containing dissociative vinyl monomer such as acrylic acid, methacrylic acid, maleic acid, cinnamic acid, or fumaric acid is effective in controlling the degree of polymerization and the glass transition temperature of a polymer to be formed.

Alternatively, a crystalline resin may be used as the binder resin for a core layer, as described above. The "crystalline" resin shows a clear-cut endothermic peak rather than a stepwise endothermic change in differential scanning calorimetry (DSC), and specifically, has an endothermic peak having a half breadth of 6° C. or less as measured at a programming rate of 10° C./min.

The crystalline resin is preferably a polyester resin from the practical viewpoint of preservability of a toner image. Hereinafter, a polyester resin will be explained, but the invention is not limited by the polyester resin.

The crystalline polyester resin used in the invention and other polyester resins are made from polyvalent carboxylic acid components and polyhydric alcohol components. In the invention, the polyester resin can be a commercially available product or a non-commercial one.

Examples of the polyvalent carboxylic acid component include fatty dicarboxylic acids such as oxalic acid, succinic acid, glutalic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, including dibasic acids such as phthalic acid, isophthalic acid, terephthalic acid, naphthalene-2,6-dicarboxylic acid, malonic acid, and mesaconic acid; and anhydrides and lower alkyl esters thereof.

Examples of carboxylic acid having polyvalence of not less than trivalence include 1,2,4-benzenetricarboxylic acid, 1,2,5-benzenetricarboxylic acid, 1,2,4-naphthalenetricarboxylic acid, and anhydrides and lower alkyl esters thereof.

One of these acids may be used alone or two or more of them can be used together.

In addition, the acid components preferably contain a sulfonate group-containing dicarboxylic acid in addition to the aliphatic and/or aromatic dicarboxylic acid. The sulfonate group-containing dicarboxylic acid is effective in well dispersing a colorant such as a pigment. When the acid components contain a sulfonate group-containing dicarboxylic acid, the resultant resin can be emulsified or suspended in water without use of a surfactant to prepare resin fine particles, as will be described later.

Examples of the sulfonate group-containing dicarboxylic acid include, but are not limited to, sodium 2-sulfoterephthalate, sodium 5-sulfoisophthalate, and sodium sulfosuccinate, and lower alkyl esters and anhydrides thereof. The content of the sulfonate group-containing carboxylic acid component having polyvalence of not less than bivalence is preferably about 1 to about 15 mole %, and more preferably about 2 to about 10 mole % with respect to all the carboxylic acid components used to prepare the polyester.

When the content is small, stability of emulsified particles over time deteriorates. When the content is more than 15 mole %, the resultant polyester resin has deteriorated crystallinity, which adversely affects fusing the agglomerates and makes it difficult to control the toner diameter.

The acid components more preferably include a double bond-containing dicarboxylic acid component in addition to the fatty dicarboxylic acid and/or the aromatic dicarboxylic acid. The double bond-containing dicarboxylic acid is preferably used for prevention of hot offsetting in the fixing step, because the double bond can radically form a cross-linked bond. Examples of such dicarboxylic acid include, but are not limited to, maleic acid, fumaric acid, 3-hexenedioic acid, and 3-octenedioic acid, and lower esters and anhydrides thereof. The double bond-containing dicarboxylic acid is preferably fumaric acid, and/or maleic acid because of its low cost.

The polyvalent alcohol component is preferably an aliphatic diol, and more preferably a linear aliphatic diol having 7 to 20 carbon atoms in the main chain thereof. When the aliphatic diol is branched, the crystallinity and the melting point of the resultant polyester resin decrease, leading to deterioration in toner-blocking resistance, image storability, and low-temperature fixing property. When the diol has six or less carbon atoms, polyester obtained by condensation-polymerizing such diol and an aromatic dicarboxilic acid may have a high melting point, making it difficult to fix the toner including such polyester at a low temperature. When the diol has 21 or more carbon atoms, such diol tends to be less available. The diol more preferably has 14 or less carbon atoms.

Typical examples of the aliphatic diol preferably used in production of the crystalline polyester for use in the invention include, but are not limited to, ethylene glycol, 1,3-propanediol, 1,4-butenediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, the aliphatic diol is preferably 1,8-octanediol, 1,9-nonanediol, and/or 1,10-decanediol from the viewpoint of availability.

Examples of the alcohol having polyvalence of not less than trivalence include glycerol, trimethylolethane, trimethylolpropane, and pentaerythritol. One of these polyols may be used alone or two or more of them can be used together.

The content of the aliphatic diol component(s) in the polyhydric alcohol component(s) is preferably 80 mole % or more, and more preferably 90 mole % or more. When the content is less than 80 mole %, the resultant polyester resin may have decreased crystallinity and a decreased melting point, which may deteriorate toner-blocking resistance, image storability and low-temperature fixing property. For adjustment of acid and/or hydroxyl values, a monovalent acid such as acetic acid or benzoic acid, and/or a monovalent alcohol such as cyclohexanol or benzyl alcohol may also be used, as needed.

A resin fine particle dispersion liquid can be prepared by dispersing the crystalline resin in an aqueous medium, such as water, containing an ionic surfactant and/or a polyelectrolyte such as a polymer acid or a polymer base, heating the dispersion to a temperature equal to or higher than the melting point of the resin and stirring the dispersion with a high-pressure discharging disperser or a homogenizer which can provide strong shearing force.

Alternatively, a mixture of plural resins may be used as the binder resins for a core layer in the invention. In this case, a mixture of a crystalline resin and an amorphous resin may be used.

The resin fine particles used in preparing a toner preferably have a volume-average diameter in the range of 1 μm or less and more preferably about 0.01 to about 1 μm. When the resin fine particles having a volume-average diameter of more than 1 μm, toner particles finally obtained for developing electrostatic latent images may have broadened diameter and shape distributions, or free particles occur and make the compositions of the toner particles uneven, consequently leading to deterioration in properties and reliability of the toner.

On the other hand, resin fine particles having a volume-average diameter in the above range do not cause the defects described above, suppress uneven compositions of the toner particles, and can be well dispersed in the toner, and lessen unevenness of properties and reliability of the toner. The volume-average diameter of the resin fine particles can be measured with, for example, a particle distribution analyzer such as MICTOTRAC.

Second Binder Resin (Binder Resin for Shell Layer)

A material similar to that for the binder resin for a core layer may be used as the second binder resin for use in the invention (hereinafter, referred to as a "binder resin for a shell layer" or "shell layer binder resin). However, it is not preferable that the binder resin for a shell layer is a crystalline resin. When a crystalline resin, whose electric resistance is greatly influenced by environmental conditions, is used as the material for a shell layer, which is the outermost layer of a toner, the toner may have drastically deteriorated chageability in a high-humidity environment.

Preferably, the binder resin for a shell layer is incompatible with that for a core layer at the time that a toner is produced. Moreover, conditions during production of the toner are preferably so selected as to easily keep these binder resins at an incompatible state.

The binder resin for a core layer and that for a shell layer used to produce the toner are preferably selected in such a manner that the difference between the solubility parameter of the binder resin for a core layer (SPc) and that of the binder resin for a shell layer (SPs), ($\Delta SP=|SPc-SPs|$), becomes in the range of about 0.2 to about 0.6. The difference is more preferably in the range of about 0.2 to about 0.4.

When the ΔSP value is less than 0.2, the binder resin for a core layer and that for a shell layer may be compatible with each other in a toner, which may make it difficult for the viscoelasticity of the toner to be so controlled as to satisfy the requirement represented by Formula (2). When the ΔSP value is larger than 0.6, the binder resin for a core layer and that for a shell layer may have poor affinity, which may make it difficult to uniformly fuse these binder resins and to produce a toner.

In addition, it is preferable to use the binder resin for a core layer and that for a shell layer in such a manner that the ratio of the storage modulus of the binder resin for a core layer at 80° C., $G'_{core}(80)$, to that of the binder resin for a shell layer at 80° C., $G'_{shell}(80)$, $[G'_{shell}(80)/G'_{core}(80)]$, is about 5 to about 50. The ratio is more preferably about 10 to about 30.

When the ratio of $G'_{shell}(80)/G'_{core}(80)$ is less than about 5, it may be difficult to obtain dependence of toner viscoelasticity on temperature (slope) that satisfies the requirement represented by Formula (2).

When the ratio of $G'_{shell}(80)/G'_{core}(80)$ is greater than about 50, the difference between the storage modulus of the binder resin for a core layer and that of the binder resin for a shell layer is too large. Therefore, the binder resin for a core layer may melt but that for a shell layer may not melt during fixing at a temperature which is the sole set fixing temperature of a fixing unit. In such a case, there are both melted and unmelted regions in the resulting fixed image, which may result in irregularity of the image surface and deteriorated color development.

In order to easily realize control of the toner viscoelasticity satisfying the requirement represented by Formula (2), the storage modulus of the binder resin for a core layer at 80° C., $G'_{core}(80)$, is preferably in the range of about $1\times10^4$ Pa to about $1\times10^5$ Pa, and the storage modulus of the binder resin for a shell layer at 80° C., $G'_{shell}(80)$, is preferably in the range of about $5\times10^4$ Pa to about $5\times10^6$ Pa.

In the invention, the SP (solubility parameter) value is determined in accordance with Fedors' method. Specifically, the SP value is defined by the following Formula (3).

$$SP = \sqrt{\frac{\Delta E}{V}} = \sqrt{\frac{\sum_i \Delta ei}{\sum_i \Delta vi}} \qquad \text{Formula (3)}$$

In Formula (3), SP represents a solubility parameter; ΔE represents aggregation energy (cal/mol); V represents a molar volume ($cm^3$/mol); Δei represents the vaporization energy of the i-th atom or atomic group (cal/atom or atomic group); Δvi represents the molar volume of the i-th atom or atomic group ($cm^3$/atom or atomic group); and i represents an integer of 1 or more.

The SP value represented by Formula (3) commonly has a unit of $cal^{1/2}/cm^{3/2}$, and is expressed as a dimensionless value. In addition, since the relative difference between the SP values of two compounds are of significance in the invention, the SP value is calculated according to the common practice described above and expressed as a dimensionless value.

For reference, to convert the SP value calculated according to Formula (3) into a value having an SI unit ($J^{1/2}/m^{3/2}$), the SP value is multiplied by 2046.

Colorant

The type of the colorant for use in the toner is not particularly limited, and any of known pigments, and dyes may be used as the colorant. Examples of the pigments include black pigments, yellow pigments, orange pigments, red pigments, blue pigments, purple pigments, green pigments, white pigments, and extender pigments.

Examples of the black pigments include carbon black, copper oxide, manganese dioxide, aniline black, and activated carbon.

Examples of the yellow pigments include chrome yellow, zinc yellow, yellow iron oxide, cadmium yellow, Hanza yellow, Hanza Yellow-10G, Benzidine Yellow G, Benzidine Yellow GR, threne yellow, quinoline yellow, and Permanent Yellow NCG.

Examples of the orange pigments include red chrome yellow, molybdenum orange, Permanent Orange GTR, pyrazolone orange, Vulcan Orange, benzidine orange G, Indanthren brilliant orange RK, and Indanthren Brilliant Orange GK.

Examples of the red pigments include iron oxide red, cadmium red, red lead, mercury sulfide, Watchung Red, Permanent Red 4R, Lithol Red, Brilliant Carmine 3B, Brilliant Carmine 6B, Du Pont oil red, pyrazolone red, Rhodamine B Lake, Lake Red C, rose bengal, eoxine red, and alizarin lake.

Examples of the blue pigments include iron blue, cobalt blue, alkali blue lake, Victoria Blue Lake, Fast Sky Blue, Indanthren Blue BC, aniline blue, ultramarine blue, Calco Oil Blue, methylene blue chloride, phthalocyanine blue, phthalocyanine green, and malachite green oxalate.

Examples of the purple pigments include manganese purple, Fast Violet B, and methyl violet lake.

Examples of the green pigments include chromium oxide, chromium green, pigment green, phthalocyanine green, malachite green lake, and Final Yellow Green G.

Examples of the white pigments include zinc white, titanium oxide, antimony white, and zinc sulfide.

Examples of the extender pigments include barytes, barium carbonate, clay, silica, white carbon, talc, and alumina white.

Examples of the dyes include basic, acidic, disperse, and direct dyes, such as acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, and thiazole dyes. More specifically, the dye can be nigrosine, methylene blue, rose bengal, quinoline yellow, and/or ultramarine blue.

These colorants may be used alone, or two or more of them can be used together. Moreover, the colorant(s) can be used in the state of a solid solution. When two or more colorants are contained in the toner of the invention, it is possible to freely adjust the color of the toner by changing the kinds and the blending ratio of the colorants.

The colorant or colorants are selected from the viewpoints of hue angle, chroma, lightness, weather resistance, OHP permeability, and dispersing property in a toner. The content of the colorant(s) in the toner is preferably about 1 to about 20 mass % and more preferably about 4 to about 15 mass %.

In producing a colorant dispersion liquid, the colorant(s) can be dispersed in an aqueous medium by a known method. For example, a rotary shearing homogenizer, a medium-containing disperser such as a ball mill, a sand mill, or an attritor, or a high-pressure counter collision disperser is preferably used in the dispersing.

Releasing Agent

Any of known releasing agents may be contained in the toner of the invention. Examples thereof include low-molecular weight polyolefins such as polyethylene, polypropylene, and polybutene; silicones that have a softening point by heating; fatty acid amides such as oleic amide, erucic amide, ricinoleic amide, and stearic amide; vegetable waxes such as ester wax, carnauba wax, rice wax, candelilla wax, Japan tallow, and jojoba oil; animal waxes such as beeswax; mineral/petroleum waxes such as montan wax, ozokerite, ceresin, paraffin wax, microcrystalline wax, and Fischer-Tropsch wax; and modified products thereof.

A releasing agent dispersion liquid can be prepared by dispersing the releasing agent, an ionic surfactant, and/or a polyelectrolyte such as polymeric acid or base in water, and heating the resultant dispersion liquid to a temperature equal to or higher than the melting point of the releasing agent and applying strong shearing force to the dispersion liquid with a homogenizer or a high-pressure discharging disperser to form fine particles in the medium. This method makes it easy to control the diameter of the releasing agent particles dispersed in the releasing agent dispersion liquid to 1 μm or less, which is suitable for toner production.

The volume-average diameter of the releasing agent particles is preferably 1 μm or less and more preferably in the range of about 0.01 to about 1 μm. A volume-average diameter of over 1 μm may lead to broaden particle diameter and shape distributions of the resultant toner, generating free particles, causing uneven compositions of the toner particles and deteriorating the properties and reliability of the toner.

On the other hand, the releasing agent particles having a volume-average diameter in the above range do not cause such defects. That is, the compositions of the toner particles are less uneven, and the releasing agent can be well dispersed in the toner, and the toner has decreased unevenness in properties and reliability thereof. The volume-average diameter can be measured with, for example, a particle distribution analyzer such as MICROTRAC.

Other Components

Examples of other components serving as internal or external additives for the toner include a charge control agent, inorganic particles, organic particles, a lubricant, an abrasive, or magnetic powder.

Examples of the charge control agent include quaternary ammonium salt compounds, nigrosin compounds, dyes which are complexes with a metal such as aluminum, iron, or chromium, and triphenylmethane pigments. The charge control agent preferably has low solubility in water to control the ionic strength of toner, which influences the stability of the toner particles during aggregation and fusion, and to reduce the degree of wastewater pollution.

Examples of the inorganic powder include powder of external additives added to toner surfaces such as silica, alumina, titania, calcium carbonate, magnesium carbonate, tricalcium phosphate, and cerium oxide.

Examples of the organic powder include particle of external additives added to toner surfaces such as vinyl resins, polyester resins, and silicone resins. The inorganic and/or organic powder can be used as a flowability-improving aid, and/or a cleaning aid.

Examples of the lubricant include fatty acid amides such as ethylenebisstearic amide and oleic amide; and fatty acid metal salts such as zinc stearate and calcium stearate. Examples of the abrasive include silica, alumina, and cerium oxide, as aforementioned.

The magnetic powder may be a substance which can be magnetized in a magnetic field, and examples thereof include ferromagnetic powders of metals, such as iron, cobalt, nickel, and manganese, alloys thereof, and compounds containing the metal or alloy; and ferrite and magnetite. When the toner of the invention includes the magnetic powder, the migrating property of the magnetic substance to an aqueous phase is preferably reduced before addition thereof to a system for preparing a toner, and the magnetic substance is thus preferably subjected to surface modification, for example, treatment of hydrophobilizing the magnetic substance.

When these other components are used in the form of particles in production of a toner, the volume-average particle diameter of each of these components is preferably about 0.01 to about 1 μm. The volume-average particle diameter can be measured with, for example, a particle analyzer such as MICROTRAC.

Dispersion Liquid

Hereinafter, dispersion media and secondary components such as a surfactant for use in preparing various dispersion liquids, which are used in production of the toner used in the invention, and methods of preparing the dispersion liquids will be described below.

First, the dispersion medium is, for example, an aqueous medium. Examples of the aqueous media include water such as distilled water and deionized water, and alcohols. These aqueous media may be used alone, or two or more of them can be used together.

In the invention, a surfactant is preferably added to and mixed with the aqueous medium in preparing each of the dispersion liquids.

Examples of the surfactant include anionic surfactants such as sulfuric esters, sulfonic acid salts, phosphoric esters, and soups; cationic surfactants such as amine salts and quaternary ammonium salts; and nonionic surfactants such as polyethylene glycol, alkylphenol ethylene oxide adducts, and polyhydric alcohols. Among them, the surfactant is preferably an ionic one, and is more preferably an anionic or cationic surfactant.

The nonionic surfactant is preferably used in combination with the anionic or cationic surfactant. These surfactants may be used alone, or two or more of them can be used together.

Typical examples of the anionic surfactant include fatty acid soaps such as potassium laurate, sodium oleate, castor oil sodium; sulfuric esters such as octyl sulfate, lauryl sulfate, lauryl ether sulfate, and nonyl phenyl ether sulfate; sulfonic acid salts such as lauryl sulfonate salts, dodecyl sulfonate, dodecyl benzenesulfonate, sodium alkylnaphthalenesufonates such as sodium triisopropylnaphthalenesulfonate, and sodium dibutylnaphthalenesulfonate, condensates of naphthalenesulfonate and formalin, monooctyl sulfosuccinate, dioctyl sulfosuccinate, lauric amide sulfonate, and oleic amide sulfonate; phosphoric esters such as lauryl phosphate, isopropyl phosphate, and nonyl phenyl ether phosphate; and sulfosuccinates such as sodium dialkylsulfosuccinates (e.g., sodium dioctylsulfosuccinate), lauryl disodium sulfosuccinate, and lauryl disodium polyoxyethylenesulfosuccinate.

Typical examples of the cationic surfactant include amine salts such as laurylamine hydrochloride, stearylamine hydrochloride, oleylamine acetate, stearylamine acetate, stearylaminopropylamine acetate; and quaternary ammonium salts such as lauryl trimethyl ammonium chloride, dilauryl dimethyl ammonium chloride, distearyl ammonium chloride, distearyl dimethyl ammonium chloride, lauryl dihydroxyethyl methyl ammonium chloride, oleyl bispolyoxyethylene methyl ammonium chloride, lauroylaminopropyl dimethyl ethyl ammonium ethosulfate, lauroylaminopropyl dimethyl hydroxyethyl ammonium perchlorate, alkylbenzene dimethyl ammonium chlorides, and alkyl trimethyl ammonium chlorides.

Typical examples of the nonionic surfactant include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate, and polyoxyethylene oleate; alkylamines such as polyoxyethylene laurylamino ether, polyoxyethylene stearylamino ether, polyoxyethylene oleylamino ether, polyoxyethylene soy bean amino ether, and polyoxyethylene beef tallow amino ether; alkylamides such as polyoxyethylene lauric amide, polyoxyethylene stearic amide, and polyoxyethylene oleic amide; vegetable oil ethers such as polyoxyethylene castor oil ether and polyoxyethylene rapeseed oil ether; alkanolamides such as lauric acid diethanolamide, stearic acid diethanolamide, and oleic acid diethanolamide; and sorbitan ester ethers such as polyoxyethylene sorbitan monolaurates, polyoxyethylene sorbitan monopalmitates, polyoxyethylene sorbitan monostearates, and polyoxyethylene sorbitan monooleates.

A mixed dispersion liquid at least containing a first resin fine particle dispersion liquid and a colorant dispersion liquid is used in the aggregation step, but, for production of a toner allowing so-called oil less fusion, the mixed dispersion liquid preferably further contains a releasing agent dispersion liquid.

In the mixed dispersion liquid containing these three dispersion liquids, the content of the first resin fine particles is preferably 40 mass % or less, and more preferably in the range of about 2 to about 20 mass % with respect to all solid matters. Moreover, the content of the colorant in all the solid matters is preferably 50 mass % or less and more preferably in the range of about 2 to about 40 mass %. Further, the content of the releasing agent in all the solid matters is preferably 50 mass % or less and more preferably in the range of about 5 to about 40 mass %.

When the mixed dispersion liquid containing the three dispersion liquids further contain at least one other internal additive component (particles), in general, it is sufficient that the amount of each of other internal additive components is extremely small. Specifically, the content of each of other internal additive components is preferably in the range of about 0.01 to about 5 mass %, and more preferably about 0.5 to about 2 mass % with respect to all the solid matters contained in the mixed dispersion liquid.

Methods of preparing the above dispersion liquids are not particularly limited, and may be suitably selected according to applications. Moreover, the dispersion apparatus is not particularly limited, and examples thereof include dispersing machines known in the art such as HOMOMIXER (Tokushu Kika Kogyo Co., Ltd.), THRASHER (Mitsui Mining Com. Public Limited Company), CAVITRON (Eurotec, Ltd.], MICROFLUIDIZER (Mizuho Industrial Co., Ltd.), Manthon-Gaulin HOMOGENIZER (Gaulin), NANOMIZER (Nanomizer), and STATIC MIXER (Noritake Co., Ltd.).

Method of Producing Toner

Hereinafter, the aggregation, adhesion, and coalescence steps in the method of producing the toner for use in the invention will be described below respectively.

Aggregation Step

In the aggregation step, a coagulant is first added to a mixed dispersion liquid obtained by mixing a first binder resin dispersion liquid, a colorant dispersion liquid, and an optional releasing agent dispersion liquid and optional components, and the resultant mixture is heated to a temperature slightly lower than the melting point of the first binder resin to form agglomerates (core agglomerates) containing the above components. Alternatively, the mixture may be heated to a temperature of not lower than the glass transition temperature of the first binder resin to simultaneously conduct aggregation and fusion and to form fused particles (core fused particles).

In forming the agglomerates, the coagulant is added to the mixed dispersion liquid, which is being agitated with a rotary shearing homogenizer, at room temperature. A surfactant having a polarity opposite to that of each of the surfactants used as the dispersants in the dispersion liquids, an inorganic metal salt, or a complex including a metal with a polyvalence of not less than bivalence is preferably used as the coagulant for use in the aggregation step.

In particular, a metal complex is preferably used, since it can reduce the amount of the surfactant(s) used in producing the toner and improves the chargeability of the toner.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Among them, the inorganic metal salt is particularly preferably an aluminum salt and/or a polymer thereof. In order to obtain a sharper melting temperature range, it is preferable to use an inorganic metal salt having a high valence. That is, bivalent one is better than monovalent one, trivalent one is better than bivalent one, and quadrivalent one is better than trivalent one. Moreover, when the valencies of the metals of the inorganic metals salts are the same, a polymeric inorganic metal salt is more preferable than a non-polymeric one.

Adhesion Step

In the adhesion step, the fine particles of a second binder resin are adhered to the surfaces of the core particles (core agglomerates or core fused particles) containing the first binder resin and prepared in the aggregation step to form a coating layer of the second binder resin. Hereinafter, the agglomerates having the coating layer on the core particle surfaces are referred to as "resin-adhered agglomerates. The coating layer corresponds to the shell layer of the toner used in the invention prepared in the coalescence step described later.

The coating layer can be formed by adding a second resin fine particle dispersion liquid and, if necessary, other components to the dispersion liquid containing the core particles formed in the aggregation step. The coating layer is formed by uniformly adhering the fine particles of the second binder resin to the core particle surfaces. The resultant resin-adhered agglomerates are heated and fused in the coalescence step described later, and the fine particles of the second binder resin contained in the resultant surface coating layer on each of the core particles are fused to form a shell layer. Thus, it become possible to effectively prevent a component, such as the releasing agent, contained in the core layer inside from bleeding on the shell layer.

A method of adding the second resin fine particle dispersion liquid to the dispersion containing the core particles and mixing the resultant mixture in the adhesion step is not particularly limited. For example, the dispersion liquid may be added gradually and continuously. Alternatively, the portions obtained by dividing the dispersion liquid may be added intermittently one by one. By adding the second resin fine particle dispersion liquid to the dispersion and mixing the resultant mixture in this manner, it becomes possible to suppress generation of fine particles and make the diameter distribution of the toner particles obtained sharp.

In the invention, the adhesion step may be conducted once or plural times. In the former case, only a single layer containing the second binder resin as the principal component is formed on the surfaces of the core agglomerates. In contrast, in the latter case, when plural dispersion liquids, such as a releasing agent dispersion liquid and a fine particle dispersion liquid containing other components, are used in addition to the second resin fine particle dispersion liquid, plural layers each containing a particular component as the principal component are formed on the surfaces of the core agglomerates.

The latter case is advantageous, because it is possible to obtain a toner having a complicated and precise layer structure and to give the toner a desired function. When the adhesion step is performed plural times or one adhesion step having plural stages is performed, it is possible to stepwise change the composition and the physical properties of the toner particles from the inside to the surface and to easily control the structure of the toner. In such a case, plural layers are formed stepwise on the core particle surfaces, and thus, it is possible to change the structure and composition of the toner particles from the inside to the surface and to thus change the physical properties of the toner. In this case, the shell layer corresponds to all layers formed on the core particle surfaces, and the outermost layer is a layer containing the second binder resin as the principal component. In the following descriptions, a case where the adhesion step is conducted once will be explained.

In the adhesion step, the temperature at which the fine particles of the second binder resin are adhered to the core particles is preferably close to the melting point of the first binder resin contained in the core agglomerates, and more preferably within the temperature range of the melting point ±10° C.

When heated at a temperature lower than the melting point of the first binder resin by a temperature more than 10° C., the fine particles of the first binder resin present on the core particle surfaces and the fine particles of the second binder resin to be adhered to the core agglomerate surfaces tend to do not easily adhere to each other, and as a result, the thickness of the formed shell layer may become uneven.

Alternatively, when heated at a temperature higher than the melting point of the first binder resin by a temperature more than 10° C., the fine particles of the first binder resin present on the core particle surfaces and the fine particles of the second binder resin to be adhered to the core particle surfaces tend to easily adhere to each other.

However, adhesiveness between these fine particles becomes too strong in the above case, and the resin-adhered agglomerates therefore undesirably bond to each other, resulting in an undesirably broaden grain size distribution of the toner particles obtained. The heating time in the adhesion step depends on the heating temperature and cannot be specified definitely, but is usually about 5 minutes to about 2 hours.

In the adhesion step, the mixture obtained by adding the second resin fine particle dispersion liquid to the dispersion containing the core particles may be allowed to stand or may be stirred gently, for example, with a mixer. The latter case is more advantageous, since uniform resin-adhered agglomerates are formed more easily.

Coalescence Step

In the coalescence step, the resin-adhered agglomerates obtained in the adhesion step are fused by heating. In the coalescence step, the particles are heated at a temperature equal to or higher than the glass transition temperature of each of the first binder resin and the second binder resin. When the heating temperature is high, the fusion (heating) time is short. Alternatively, when the heating temperature is low, the fusion (heating) time is long. Namely, the fusion time depends on the heating temperature and thus cannot be specified definitely, but is generally about 30 minutes to about 10 hours.

In the coalescence step, the two binder resins may be heated to a temperature equal to or higher than the melting point and cross-linked at the same time, or may be cross-linked after completion of the fusion. When the cross-linking reaction is performed, at least one of the first and second binder resins of the toner can be, for example, an unsaturated sulfonated crystalline polyester resin obtained by copolymerizing double-bond components. In the cross-linking reaction, a cross-linked structure is introduced by radically reacting such a cross-linkable binder resin. The following polymerization initiator is used at this time.

Examples of the polymerization initiator include t-butylperoxy-2-ethyl hexanoate, cumyl perpivalate, t-butylperoxy laurate, benzoyl peroxide, lauroyl peroxide, octanoyl peroxide, di-t-butyl peroxide, t-butylcumyl peroxide, dicumyl peroxide, 2,2'-azobisisobutylonitrile, 2,2'-azobis(2-methylbutylonitrile), 2,2'-azobis (2,4-dimethylvaleronitrile), 2,2'-azobis(4-methoxy-2,4-dimethylvaleronitrile), 1,1-bis(t-butylperoxy)3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl-4,4-bis (t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(t-butylperoxy) hexane, 2,5-dimethyl-2,5-di(benzoylperoxy)hexane, di-t-butyl-diperoxy isophthalate, 2,2-bis(4,4-di-t-butylperoxycyclohexyl) propane, di-t-butylperoxy α-methylsuccinate, di-t-butylperoxydimethyl glutarate, di-t-butylperoxy hexahydroterephthalate, di-t-butylperoxy azelate, 2,5-dimethyl-2,5-di(t-butylperoxy)hexane, diethylene glycol bis(t-butylperoxycarbonate), di-t-butylperoxytrimethyl adipate, tris (t-butylperoxy)triazine, vinyltris (t-butylperoxy)silane, 2,2'-azobis(2-methylpropionamidine dihydrochloride), 2,2'-azobis[N-(2-carboxyethyl)-2-methylpropionamidine], and 4,4'-azobis(4-cyanovaleric acid). These polymerization initiators may be used alone, or two or more of them can be used together. The amount and the kind of the polymerization initiator are selected according to the content of the unsaturated groups in the binder resin and the kind and amount of the coexisting colorant.

The polymerization initiator may be mixed with the binder resin component(s) before the emulsification step of preparing the resin fine particle dispersion liquid, or may be incorporated in the core particles formed in the aggregation step. Alternatively, it may be added to the system for preparing a toner during or after the coalescence step. When the polymerization initiator is incorporated into the system during the aggregation, adhesion, or coalescence step, or after the coalescence step, a solution in which the polymerization initiator is dissolved or emulsified is added to the dispersion liquid (e.g., resin fine particle dispersion liquid) used in each of the above steps. A known cross-linking agent, a chain transfer agent, and/or a polymerization inhibitor may be added to the polymerization initiator to control the degree of polymerization.

When the core particles are core fused particles, the fine particles of the second binder resin may be adhered thereto. In such a case, after a dispersion liquid containing the core fused particles is first filtered and the water content of the dispersion liquid is adjusted to a value in the range of about 30 to about 50 mass %, the second resin fine particle dispersion liquid is added to the resultant dispersion liquid. In this way, the fine particles of the second binder resin are adhered to the surfaces of the core fused particles.

When the water content of the dispersion liquid is lower than 30 mass %, it becomes difficult to adhere the fine particles of the second binder resin to the core fused particles and some fine particles may undesirably separate from the core fused particles. When the water content is higher than 50 mass %, it becomes difficult to stir the dispersion liquid, which may prohibit uniform adhesion of the fine particles of second binder resin onto the core fused particle surfaces.

The fine particles of the second binder resin adhered to the core fused particle surfaces can be fused by applying mechanical stress to the resin-adhered agglomerates obtained by adhering the fine particle of the second binder resin to the surfaces of the core fused particles in, for example, a Henschel Mixer after a washing/drying step described later. In this way, the particles may be fused by applying mechanical stress, instead of heating the particles in the liquid phase, in the coalescence step.

Washing/Drying Step

The fused particles obtained in the coalescence step are separated from the liquid by solid-liquid separation such as filtration, and then washed and dried. In this way, a toner to which an external additive has not been added is obtained.

The way of the solid-liquid separation is not particularly limited, but is preferably filtration under a reduced or heightened pressure from the viewpoint of productivity. In the washing step, the fused particles are preferably thoroughly washed with deionized water from the viewpoint of chargeability. Any drying method commonly practiced in the art, including vibrationally fluidized drying, spray drying, freeze drying, and flash jet drying, may be conducted in the drying step. The dried toner particles preferably have a water content of 1.0 mass % or less, and more preferably 0.5 mass % or less.

The particles obtained after the drying step can be used as toner mother particles, and a known other component (e.g., an external additive) may be added to the surfaces of the toner mother particles according to the application of the toner. Specific examples of other component include inorganic fine particles, organic fine particles, a charge control agent, and a releasing agent.

Examples of the material of the inorganic fine particles include silica, alumina, titanium oxide, barium titanate, magnesium titanate, calcium titanate, strontium titanate, zinc oxide, quartz sand, clay, mica, wollastonite, diatomaceous soil, cerium chloride, red iron oxide, chromium oxide, cerium oxide, antimony trioxide, magnesium oxide, zirconium oxide, silicon carbide, and silicon nitride. Among them, the inorganic fine particles are preferably silica fine particles, and more preferably hydrophobilized silica fine particles.

The inorganic fine particles are used generally to improve the flowability of the toner. Among the above inorganic fine particles, metatitanic acid, $TiO(OH)_2$, can provide a developer having superior chargeability, environmental stability, flowability, caking resistance, a stable property of being negatively charged, and a stable image quality retaining property without affecting transparency.

In addition, metatitanic acid compound is preferably hydrophobilized and such metatitanic acid preferably has an electric resistance of $10^{10}$ Ω·cm or more. The reason for this is as follows. Toner particles to the surfaces of which such metatitanic acid has been added can have a good transfer property without generation of charged toner particles having a polarity opposite a desired polarity, even when the electric voltage at the time of transfer is strengthened.

Examples of the material of the organic fine particles include polystyrene, polymethyl methacrylate, and polyvinylidene fluoride. The organic fine particles are generally used to improve the cleaning property and/or transfer property of the toner.

The inorganic and/or organic fine particles preferably have a number-average diameter of 80 nm or less and more preferably 50 nm or less. When used as an external additive, monodisperse spherical silica and/or monodisperse spherical resin fine particles preferably have a median diameter of not less than 0.1 μm but less than 0.3 μm to improve and preserve the transfer property of the toner.

Examples of the charge control agent include salicylic acid metal salts, metal-containing azo compounds, nigrosin, and quaternary ammonium salts. The charge control agent is generally used to improve the chargeability of the toner.

In the invention, the external additive is added to and mixed with toner mother particles. The mixing may be performed with, for example, a known mixer such as V-type blender, Henschel Mixer, or Redige mixer. Other additive may also be added as needed during the mixing. Examples of other additive include a fluidizing agent other than those described above, and cleaning and transfer aids such as polystyrene microparticles, polymethyl methacrylate microparticles, and polyvinylidene fluoride microparticles.

In the invention, the adhesion of the inorganic compound onto the toner particle surfaces may be simple mechanical adhesion or loose fixing on the surfaces. In addition, the inorganic compound may cover the entire or partial surface of each of the toner particles. The amount of the external additive added is preferably in the range of about 0.3 to about 3 parts by mass, and more preferably about 0.5 to about 2 parts by mass with respect to 100 parts by mass of the toner mother particles.

When the addition amount is less than 0.3 parts by mass, toner flowability may be insufficient and blocking prevention of the toner when stored under a high-temperature environment tends to be insufficient. When the addition amount is more than 3 parts by mass, the toner mother particles may be excessively coated. Thus, excess inorganic oxide particles externally added to the toner particle surfaces may migrate from the toner particles to a member that is brought into contact with the toner, causing secondary defects. The toner particles the surfaces of which the external additive has been added may be screened with a sieve.

The toner for use in the invention can be produced by the production method described above, but the invention is not limited by the production method.

Developer

As described above, the developer for use in the invention can be a one-component developer including only the toner satisfying Formulae (1) and (2) or a two-component developer including the toner satisfying Formulae (1) and (2) and a carrier.

The type of the carrier usable in the two-component developer is not particularly limited, and any known carrier may be used. A resin-coated carrier with a resin coating layer, in which particles of an electrically conductive material are dispersed in a matrix resin, formed on core material surfaces may be used as the carrier. Even when the resin coating layer undesirably falls off, the specific volume resistivity thereof does not significantly change. Therefore, the resin-coated carrier can retain high image quality for a long period of time.

Examples of the matrix resin include, but are not limited to, polyethylene, polypropylene, polystyrene, polyacrylonitrile, polyvinyl acetate, polyvinyl alcohol, polyvinylbutyral, polyvinyl chloride, polyvinylcarbazole, polyvinyl ether, polyvinyl ketone, vinyl chloride-vinyl acetate copolymer, styrene-acrylic acid copolymer, straight silicone resin having organosiloxane bonds and modified products thereof, fluorinated resins, polyester, polyurethane, polycarbonate, phenol resins, amino resins, melamine resins, benzoguanamine resins, urea resins, amide resins, and epoxy resins.

Examples of the electrically conductive material include, but are not limited to, metals such as gold, silver and copper, titanium oxide, zinc oxide, barium sulfate, aluminum borate, potassium titanate, tin oxide, and carbon black. The content of the electrically conductive material is preferably in the range of about 1 to about 50 parts by mass, and more preferably about 3 to about 20 parts by mass with respect to 100 parts by mass of the matrix resin.

A core made of magnetic powder or a core in which magnetic fine particles are dispersed in a resin may be used as the core of the carrier. A method in which the magnetic powder is formed into fine particles and the fine particles are dispersed in a resin can be a method of kneading the resin and the fine particles and pulverizing the resultant mixture, a method spray-drying a melted mixture of the resin and the magnetic powder, or a method of polymerizing a magnetic powder-containing resin in a solution (polymerization method). The core is preferably magnetic powder-dispersed one prepared by the polymerization method from the viewpoints of the degree of freedom in controlling the absolute specific gravity and the shape of the carrier.

The carrier preferably contains the magnetic fine particles in an amount of 80 mass % or more with respect to the total carrier weight from the viewpoint of prevention of undesirable scattering of the carrier. Examples of the material of the magnetic fine particles (magnetic powder) include magnetic metals such as iron, nickel, and cobalt, and magnetic oxides such as ferrite and magnetite. The volume-average diameter of the core particles is generally in the range of about 10 to about 500 μm and preferably in the range of about 25 to about 80 μm.

A method of forming the resin coating layer on the surface of the core to form the carrier include a method of immersing the carrier core in a coating layer-forming solution containing the matrix resin, the electrically conductive material and a solvent, a method of spraying the coating layer-forming solution on the surface of the carrier core, a fluidized bed method of spraying the coating layer-forming solution on the carrier core floated in fluidization air, or a method of mixing the carrier core and the coating layer-forming solution in a kneader coater and removing the solvent therefrom.

The solvent for use in the coating layer-forming solution need dissolve the matrix resin, and examples thereof include aromatic hydrocarbons such as toluene and xylene; ketones such as acetone and methyl ethyl ketone; and ethers such as tetrahydrofuran and dioxane. In the invention, the average thickness of the resin-coating layer is usually in the range of about 0.1 to about 10 μm, and, in order to secure a stable specific volume resistivity of carrier over time, preferably in the range of about 0.5 to about 3 μm.

In order to obtain high image quality, the specific volume resistivity of the carrier for use in the invention is preferably in the range of about $10^6$ to about $10^{14}$ Ω·cm, and more preferably about $10^8$ to about $10^{13}$ Ω·cm at 1,000V which corresponds to the upper or lower limit of ordinary developing contrast potential. When the specific volume resistivity of the carrier is less than $10^6$ Ω·cm, thin line images may be reproduced inaccurately and toner fogging in a background portions caused by injection of electric charges may often occur. When the specific volume resistivity of the carrier is greater than $10^{14}$ Ω·cm, a black solid image and a halftone image may be reproduced inaccurately. Moreover, an increased amount of the carrier undesirably migrates to the image-holding member (photoreceptor), and often damages the photoreceptor.

When the developer for use in the invention is a two-component developer, it is preferable that the amount of the toner mixed with 100 parts by mass of the carrier is in the range of about 3 to about 15 parts by mass.

Image-forming Method

Hereinafter, steps which are important to suppress generation of halftone offsetting in the image-forming method of to the invention, particularly a step of pseudo-halftone processing, which relates to control of the sizes of the toner aggregates, and a step of forming a latent image, which relates to control of beam diameters, will be described in detail with reference to a typical example and numerical formulae.

Pseudo-halftone Processing (FM Screening)

FM screening will be described as a typical example of the pseudo-halftone processing that results in the toner aggregates on the surface of the latent image-holding member having uneven sizes.

Figure 2:
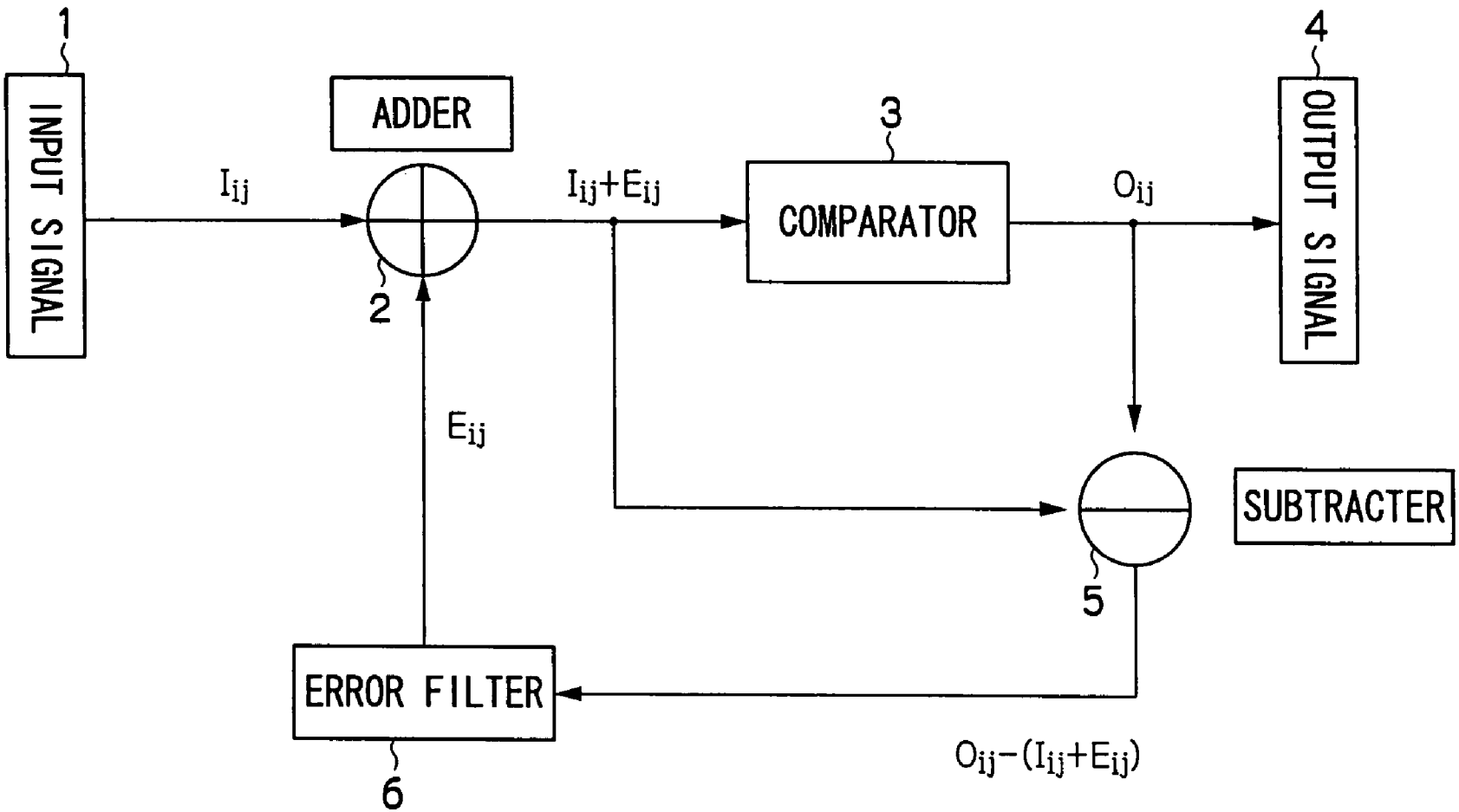
FIG. 2 is a block diagram showing the configuration of an apparatus for FM screening.

FIG. 1 is a flowchart showing the processing procedures in the FM screening, and FIG. 2 is a block diagram showing the configuration of a device for FM screening. In FIG. 2, numeral 1 represents an input signal; numeral 2 represents an adder; numeral 3 represents a comparator; numeral 4 represents an output signal; numeral 5 represents a subtracter; and numeral 6 represents an error filter.

The processing procedures in the FM screening will be first described schematically with reference to FIG. 1. In the FM screening, an image coordinate (x, y) is first initialized (Step 1). Then, after binarization processing and error diffusion processing to surrounding pixels, the image coordinate (x, y) is updated (Step 2). A check is made to determine whether the updated image coordinate (x, y) is in an image region. When the updated image coordinate (x, y) is in the image region, the coordinate is processed again in Step 2. Meanwhile, when the updated image coordinate (x, y) is outside the image region, the coordinate (x, y) is not processed any more (Step 3).

Image coordinates for all pixels in the image region are subjected to the processing of Steps 1 to 3, and the error diffusion processing is then finished.

Next, the processing will be described in more detail with reference to FIG. 2. In the binarization processing and error diffusion processing of Step 2, each image coordinate (x, y) is processed in the following manner. In the following descriptions, an image coordinate (i, j) in the image region is processed, and the pixel value at the image coordinate (i, j) is designated as Iij.

In the binarization, the pixel at the image coordinate (i, j) is binarized. The pixel value Iij for the image coordinate (i, j) is input to an adder 2 as an input signal 1. An error value (Eij) generated in processing of surrounding pixels has already been allocated to the value Iij. Thus, the adder 2 adds the error value Eij to the input pixel value Iij. The error value Eij is an integrated value of all errors which are allocated to the image coordinate (i, j) by processing the surrounding pixels. The sum of the input pixel value and the error value is input to the comparator 3, which compares the sum with a predetermined threshold value to obtain a binary data. As a result, an output pixel value Oij which is the binary data and which serves as an output signal 4 is output to a unit for driving a laser.

After the binarization, error diffusion to the surrounding pixels is conducted in the error diffusion step. In this processing, the subtracter 5 calculates the difference between the sum of the input pixel value Iij and the error value Eij which sum has been calculated by the adder 2 and the output pixel value Oij, (Oij−(Iij+Eij)), and the difference is allocated to the surrounding pixels according to the error filter 6.

In such a way, error diffusion processing in processing a data for one pixel is executed. As described above, the above processing is repeated for all the image coordinates (x, y) in the image region to obtain output pixel values Oij.

A latent image is formed on the latent image-holding member based on the output signals thus obtained. When a final image obtained by processing original image information is a halftone image, a toner image having toner aggregates with uneven sizes is formed on the latent image-holding member surface after development.

Figure 3:
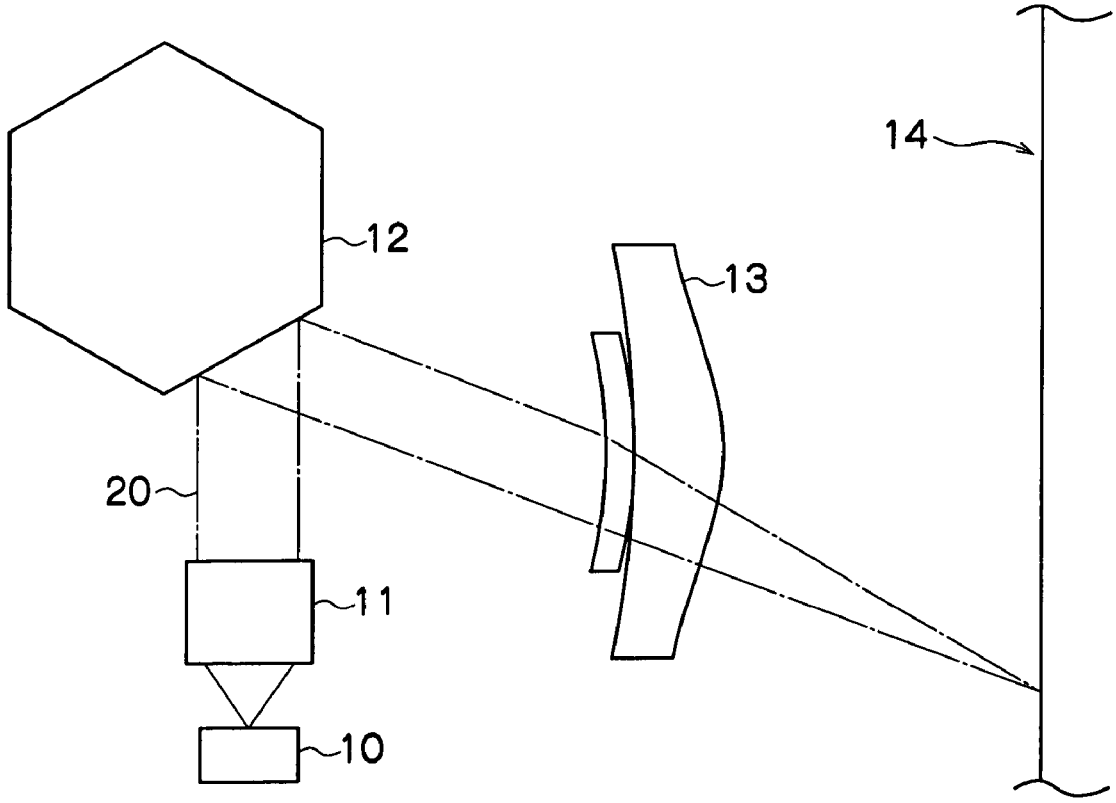
FIG. 3 is a top view illustrating the configuration of a light beam-scanning unit used to irradiate radiation beams in the latent image-forming step of the image-forming method according to the invention.

FIG. 3 is a schematic view illustrating the configuration of a light beam-scanning unit used to irradiate radiation beams in the latent image-forming step of the image-forming method according to the invention.

In the figure, numeral 10 represents a light exposure source; numeral 11 represents a collimator lens; numeral 12 represents a polygon mirror; numeral 13 represents a f-θ lens; numeral 14 represents a latent image-holding member surface; and numeral 20 represents a laser beam.

Light exposure in the latent image-forming step is performed as follows. First, a laser beam 20 emitted from the light exposure source 10 such as a semiconductor laser is collimated by the collimator lens 11, and the collimated beam is reflected and deflected by the polygon mirror 12, which is being rotated. Then, the laser beam 20 deflected by the polygon mirror 12 passes through the f-θ lens 13 and reaches the latent image-holding member surface 14 and serves as a radiation beam. The f-θ lens 13 adjusts the diameter of the deflected laser beam 20 so that the radiation beam has a predetermined diameter on the latent image-holding member surface 14. An electrostatic latent image is formed on the latent image-holding member surface 14 by repeating the irradiation process according to image information in the main scanning direction and by moving the latent image-holding member in the sub scanning direction.

Not only the semiconductor laser, but also other source such as an LED array can be used as the light exposure source 10 for forming a latent image.

According to considerations of an image-forming optical system, given the convergence angle of a beam is designated as $\theta_{beam}$, the wavelength of the beam is designated as $\lambda$, and the refractive index of a lens is designated as n, the minimum beam diameter, $\omega 0$, in Gaussian beam propagation can be calculated in accordance with the following Formula (4).

$$\omega 0 \approx \lambda/(n \cdot \pi \cdot \theta_{beam}) \quad \text{Formula (4)}$$

In addition, given the diameter of an incident beam to the f-θ lens is designated as D, and the focal length of the f-θ lens is designated as f, the beam convergence angle $\theta_{beam}$ can be calculated in accordance with the following Formula (5).

$$\theta_{beam} = \tan-1[D/(2 \cdot f)] \quad \text{Formula (5)}$$

Thus, the beam diameter can be changed by altering the wavelength $\lambda$ and the diameter of the incident light to the f-θ lens D, i.e., the diameter of the incident beam to the polygon mirror.

<Image-forming Apparatus>

Hereinafter, an image-forming apparatus of the invention will be described. The image-forming apparatus of the invention can be a known electrophotographic image-forming apparatus which can implement the image-forming method of the invention, and preferably has the following configuration.

Specifically, the image-forming apparatus of the invention preferably has a latent image-holding member, a pseudo-halftone processor for pseudo-halftone-processing an input signal corresponding to image information to generate an output signal, a latent image-forming unit for irradiating a radiation beam corresponding to the output signal on the surface of the latent image-holding member to form a latent image, a developing unit for developing the latent image with a developer which includes a toner containing a binder resin and a colorant to form a toner image on the surface of the latent image-holding member, a transfer unit for transferring the toner image onto a recording medium, and a fixing unit for fixing the toner image on the recording medium to form an image.

In such a case, the pseudo-halftone-processor utilizes a pseudo-halftone-processing method such as FM screening which, when a halftone image is formed as the image, results in the toner aggregates of a toner image, transferred onto a recording medium, having uneven sizes. It is necessary that the latent image-forming unit provides a radiation beam having a diameter of 35 μm or more. In addition, a toner satisfying aforementioned Formulae (1) and (2) is used in the apparatus.

In addition, the image-forming apparatus of the invention may include other known units, for example, an electrifier for electrically charging the latent image-holding member surface, and a cleaner for cleaning the toner remaining on the latent image-holding member surface after transfer of the toner image, such as a cleaning blade. In particular, the transfer unit of the apparatus preferably has an intermediate transfer member to further suppress halftone offsetting.

When a full-color image is formed, the image-forming apparatus may be one which sequentially forms toner images having predetermined colors on one latent image-holding member, or a so-called tandem apparatus having one latent image-holding member for each color.

The fixing unit has a heater, such as a halogen lamp, at least having a function of heating a toner image. Preferably, the fixing unit additionally has a function of saving power during stand-by periods by which function, when an image is not formed for a while, namely when the apparatus is in the so-called stand-by mode, the temperature of the heater and/or a nip portion where a toner image is fixed is made lower than the temperature thereof at the time of fixing (or by which function power consumption of the heater is decreased)

In this way, an excellent effect of saving energy can be obtained. In contrast, conventional image-forming apparatuses having a function of saving power during stand-by periods often cause halftone offsetting when the fixing temperature becomes high in successively forming halftone images after the stand-by mode. This is because such apparatuses have a greater fluctuation of the fixing temperature due to initial overshoot. However, even when the image-forming apparatus of the invention has a function of saving power during stand-by periods, the apparatus suppresses halftone offsetting.

Halftone offsetting often occurs in image-forming apparatuses with a fixing unit which has small heat capacity and which tends to undesirably raise the degree of overshoot. However, the image-forming apparatus of the invention can suppress halftone offsetting, even when the apparatus has a fixing unit with small heat capacity.

EXAMPLES

Hereinafter, the invention will be described with reference to Examples, but it should be understood that the invention is not limited to these Examples.

Preparation of Core Layer Binder Resin Particle Dispersion Liquid (1)

| | |
|---|---|
| Styrene | 410 parts by mass |
| n-Butyl acrylate | 90 parts by mass |
| Acrylic acid | 12.5 parts by mass |
| Hexanediol diacrylate | 2.5 parts by mass |
| Dodecanethiol | 12 parts by mass |

The above components are mixed to obtain a solution. To the solution, another solution in which 6 parts by mass of a nonionic surfactant (NONIPOL 400 manufactured by Sanyo Chemical Industries Ltd.) and 10 parts by mass of an anionic surfactant (NEOGEN SC manufactured by Dai-ichi Kogyo Seiyaku Co., Ltd.) have been dissolved in 740 parts by mass of deionized water is added. The resultant mixture is stirred in a flask to emulsify the mixture and is further stirred gently for 10 minutes. A solution in which 8 parts by mass of ammonium persulfate has been dissolved in 50 parts by mass of deionized water is added to the resultant emulsion, which is being stirred. After the air in the flask is substituted with nitrogen, the emulsion in the flask, which is being stirred, is heated to 68° C. in an oil bath and kept at that temperature for 7 hours, allowing emulsion polymerization to proceed.

In this way, a core layer binder resin particle dispersion liquid (1) containing core layer binder resin particles having a volume-average diameter of 190 nm and a weight-average molecular weight Mw of 33,000 is prepared. The water content of the liquid is adjusted so that the content of the core layer binder resin in the liquid becomes 10 mass %. The calculated SP value of the core layer binder resin is 9.93.

Preparation of Core Layer Binder Resin Particle Dispersion Liquid (2)

98.0 mol % of 1,8-sebacic acid, 2.0 mol % of sodium dimethyl isophthalate-5-sulfonate, 100 mol % of 1,6-hexanediol and a catalyst $Ti(OBu)_4$ (0.014 mass % with respect to acid component) are placed in a heat-dried three-necked flask, and the internal pressure of the flask is decreased through pressure-decreasing operation, and the air in the flask is substituted with nitrogen gas. The mixture in the flask is refluxed at 180° C. for 6 hours while stirred mechanically under the inert atmosphere.

Then, the mixture is distilled under a reduced pressure to remove excessive ethylene glycol therefrom. The temperature of the mixture is raised gradually to 220° C., and the mixture is stirred at that temperature for 4 hours. When the mixture has become viscous, the molecular weight of the resultant product is measured by GPC (gel-permeation chromatography). The measurement is repeated until the weight-average molecular weight Mw of the product reaches 28,000. Then, the distillation under a reduced pressure is terminated and the reaction system is air-cooled to obtain a core layer binder resin. The acid value of the binder resin is 9.8 mg KOH/g.

Then, the binder resin which is melting is fed into a device, CAVITRON CD1010 manufactured by Eurotec, Ltd., at a velocity of 100 g/min. Moreover, diluted aqueous ammonia prepared by diluting a reagent, aqueous ammonia, with deionized water, having a concentration of 0.37 mass % and placed in a separate aqueous medium tank is, after heated to 120° C. in a heat exchanger, fed to the device, CAVITRON at a speed of 0.1 liter per minute. The feeding of the melting binder resin (polyester resin) and the feeding of the diluted aqueous ammonia are conducted simultaneously.

The device is operated at a rotor rotational velocity of 60 Hz at a pressure of 5 $Kg/cm^2$ to obtain a core layer binder resin dispersion liquid (2) with particles having a volume-average diameter of 0.38 μm. The water content of the liquid is adjusted so that the content of the core layer binder resin in the liquid becomes 10 mass %. The calculated SP value of the core layer binder resin is 9.34.

Preparation of Core-Layer Binder Resin Particle Dispersion Liquid (3)

| | |
|---|---|
| Bisphenol A-ethylene oxide adduct (average added mole number of 2.1) | 850 parts by mass |
| Terephthalic acid | 1800 parts by mass |

A core layer binder resin particle dispersion liquid (3) with polyester resin particles having a weight-average molecular weight Mw of 10,000, a volume-average diameter of 0.14 μm and an SP value of 10.10 is produced in the same manner as the core layer binder resin particle dispersion liquid (2), except that the above components are used as the raw materials in the production, and except that a mixture of the components is reacted until the acid value and the softening point of the resulting resin respectively reach 8.4 mg KOH/g and 105° C.

Preparation of Shell Layer Binder Resin Particle Dispersion Liquid (1)

Bisphenol A-propylene oxide adduct (average added mole number: 2.2) 800 parts by mass Terephthalic Acid 1600 parts by mass A shell layer binder resin particle dispersion liquid (1) with polyester resin particles having a weight-average molecular weight Mw of 8,500, a volume-average diameter of 0.10 μm and an SP value of 10.50 is produced in the same manner as the core layer binder resin particle dispersion liquid (3), except that the above components are used as the raw materials in the production, and except that a mixture of the components is reacted until the acid value and the softening point of the resulting resin respectively reach 10.5 mg KOH/g and 110° C.

Preparation of Shell Layer Binder Resin Particle Dispersion Liquid (2)

| | |
|---|---|
| Styrene | 440 parts by mass |
| n-Butyl acrylate | 20 parts by mass |
| Acrylic acid | 3 parts by mass |
| Dodecanethiol | 6 parts by mass |
| Carbon tetrabromide | 4 parts by mass |

The above components are mixed to obtain a solution. To the solution, another solution in which 6 parts by mass of a nonionic surfactant (NONIPOL 400 manufactured by Sanyo Chemical Industries Ltd.) and 12 parts by mass of an anionic surfactant (NEOGEN SC manufactured by Dai-ichi Kogyo Seiyaku Co., Ltd.) have been dissolved in 550 g of deionized water is added. The resultant mixture is stirred in a flask to emulsify the mixture and is further stirred gently for 10 minutes. A solution in which 3 parts by mass of ammonium persulfate has been dissolved in 50 parts by mass of deionized water is added to the resultant emulsion, which is being stirred.

After the air in the flask is substituted with nitrogen, the emulsion in the flask, which is being stirred, is heated to 65° C. in an oil bath and kept at that temperature for 7 hours, allowing emulsion polymerization to proceed.

As a result, a shell layer binder resin particle dispersion liquid (2) containing shell layer binder resin particles having a volume-average diameter of 200 nm and a weight-average molecular weight Mw of 39,000 is prepared. The water content of the liquid is adjusted so that the content of the shell layer binder resin in the liquid becomes 10 mass %. The calculated SP value of the shell layer binder resin is 10.10.

Preparation of Releasing Agent Dispersion Liquid (1)

| | |
|---|---|
| Paraffin wax (HNP9 manufacture by Japan Seiro Co., Ltd., and having a melting point of 77° C.) | 60 parts by mass |
| Anionic surfactant (NEOGEN RK manufactured by Dai-ichi Kogyo Seiyaku Co., Ltd.) | 4 parts by mass |
| Deionzied water | 200 parts by mass |

A mixture of the above components is heated to 120° C., stirred with a homogenizer (ULTRA-TURRAX T50 manufactured by IKA) and further stirred with Manthon Gaulin high-pressure homogenizer (Gaulin) to obtain a releasing agent dispersion liquid (1) containing releasing agent particles having a volume-average diameter of 250 nm. The water content of the liquid is adjusted so that the content of the releasing agent in the liquid becomes 10 mass %.

Preparation of Colorant Dispersion Liquid (1)

| | |
|---|---|
| Cyan pigment (copper phthalocyanine B15:3 manufactured by Dainichiseika Color & Chemicals Mfg.) | 50 parts by mass |
| Nonionic surfactant (NONIPOL 400 manufactured by Kao Corporation) | 5 parts by mass |
| Deionized water | 200 parts by mass |

The above components are mixed, and stirred with a high pressure-impact dispersing machine ULTIMIZER (HJP 30006 manufactured by Sugino Machine Ltd.) for about 1 hour. The water content of the resultant dispersion liquid is adjusted to obtain a colorant particle dispersion liquid (1).

Preparation of Toner Mother Particle (1)

| | |
|---|---|
| Core layer binder resin particle dispersion liquid (1) | 720 parts by mass |
| Colorant dispersion liquid (1) | 50 parts by mass |
| Releasing agent dispersion liquid (1) | 70 parts by mass |
| Cationic surfactant (SANISOL B50 manufactured by Kao Corp.) | 1.5 parts by mass |

The above components are placed in a round stainless steel flask. Fourteen parts by mass of an aqueous nitric acid solution containing polyaluminum chloride, a coagulant, and having a concentration of 10 wt % is added thereto. The resultant mixture is stirred with a homogenizer (ULTRA-TURRAX T50 manufactured by IKA) at 30° C. and heated to 40° C. in an oil bath for heating. The volume-average diameter of the resultant core agglomerates is measured with COULTER COUNTER and is 5.5 μm.

After the mixed dispersion liquid is kept at 40° C. for 30 minutes, 160 parts by mass of the shell layer binder resin particle dispersion liquid (1) is gradually added to the mixed dispersion liquid, and the resultant mixture is kept at that temperature for 1 hour. The volume-average diameter of the resultant resin-adhered agglomerates is measured with COULTER COUNTER (TA2 MODEL manufactured by Coulter) and is 5.8 μm.

The dispersion liquid, which is being stirred, is heated to 80° C. and kept at that temperature for 3 hours. Then, the dispersion liquid is cooled to 20° C. at a speed of 1° C./min and filtered. The particles collected are washed with deionized water and dried in a vacuum dryer to obtain toner mother particles. The toner mother particles have a volume-average diameter of 5.7 μm as determined with COULTER COUNTER (TA2 MODEL manufactured by Coulter).

Preparation of Toner Mother Particle (2)

| | |
|---|---|
| Core layer binder resin particle dispersion liquid (2) | 150 parts by mass |
| Core layer binder resin particle dispersion liquid (3) | 530 parts by mass |
| Colorant dispersion liquid (1) | 50 parts by mass |
| Releasing agent dispersion liquid (1) | 70 parts by mass |
| Cationic surfactant (SANISOL B50 manufactured by Kao Corp.) | 1.5 parts by mass |

The above components are placed in a round stainless steel flask. Sixteen parts by mass of an aqueous nitric acid solution containing polyaluminum chloride, a coagulant, and having a concentration of 10 wt % is added thereto. The resultant mixture is stirred with a homogenizer (ULTRA-TURRAX T50 manufactured by IKA) at 30° C. and heated to 45° C. in an oil bath for heating. The volume-average diameter of the resultant core fused particles is measured with COULTER COUNTER and is 5.2 μm.

The dispersion liquid, which is being stirred, is heated to 95° C. and kept at that temperature for 2 hours. Then, the dispersion liquid is cooled to 20° C. at a speed of 10° C./min and filtered. The water content of the dispersion liquid is adjusted to 35 mass %. Two hundreds parts by mass of the shell layer binder resin particle dispersion liquid (1) is gradually added to the mixed dispersion liquid having a water content of 35 mass % and containing core fused particles. Furthermore, 15 parts by mass of an aqueous nitric acid solution containing polyaluminum chloride and having a concentration of 10 wt % is added to the resultant mixture, which is being stirred. The resultant blend is stirred for 240 minutes. The resulting product is washed with deionized water and dried in a vacuum dryer to obtain resin-adhered agglomerates. The resin-adhered agglomerates are agitated with a Henschel Mixer for 20 minutes to fuse the agglomerates. Thus, toner mother particles (2) are obtained.

The toner mother particles (2) have a volume-average diameter of 6.9 μm as measured with COULTER COUNTER.

Preparation of Toner Mother Particle (3)

| | |
|---|---|
| Core layer binder resin particle dispersion liquid (1) | 560 parts by mass |
| Colorant dispersion liquid (1) | 50 parts by mass |
| Releasing agent dispersion liquid (1) | 70 parts by mass |
| Cationic surfactant (SANISOL B50 manufactured by Kao Corp.) | 1.5 parts by mass |

The above components are placed in a round stainless steel flask. Fourteen parts by mass of an aqueous nitric acid solution containing polyaluminum chloride, a coagulant, and having a concentration of 10 wt % is added thereto. The resultant mixture is stirred with a homogenizer (ULTRA-TURRAX T50 manufactured by IKA) at 30° C. and heated to 40° C. in an oil bath for heating. The volume-average diameter of the resultant core agglomerates is measured with COULTER COUNTER (TA2 MODEL manufactured by Coulter) and is 5.6 μm.

After the mixed dispersion liquid containing the core agglomerates is kept at 40° C. for 30 minutes, 320 parts by mass of the shell layer binder resin particle dispersion liquid (2) is gently added to the mixed dispersion liquid, and the resultant mixture is kept at 40° C. for 3 hours. The volume-average diameter of the resultant resin-adhered agglomerates is 6.3 μm as measured with COULTER COUNTER (TA2 MODEL manufactured by Coulter). The dispersion liquid, which is being stirred, is heated to 95° C. and kept at that temperature for 5 hours. Then, the dispersion liquid is cooled to 20° C. at a speed of 1° C./min and filtered, and the resultant particles collected are washed with deionized water and dried in a vacuum dryer to obtain toner mother particles (3).

The toner mother particles (3) have a volume-average diameter of 6.2 μm as measured with COULTER COUNTER.

Preparation of Toner Mother Particle (4)

| | |
|---|---|
| Core layer binder resin particle dispersion liquid (2) | 350 parts by mass |
| Colorant dispersion liquid (1) | 50 parts by mass |
| Releasing agent dispersion liquid (1) | 70 parts by mass |
| Cationic surfactant (SANISOL B50 manufactured by Kao Corp.) | 1.5 parts by mass |

The above components are placed in a round stainless steel flask. Twelve parts by mass of an aqueous nitric acid solution containing polyaluminum chloride, a coagulant, and having a concentration of 10 wt % is added thereto. The resultant mixture is stirred with a homogenizer (ULTRA-TURRAX T50 manufactured by IKA) at 30° C. and heated to 45° C. in an oil bath for heating. The volume-average diameter of the resultant core agglomerates is measured with COULTER COUNTER (TA2 MODEL manufactured by Coulter) and is 5.3 μm.

After the mixed dispersion liquid containing the core agglomerates is kept at 45° C. for 60 minutes, 530 parts by mass of the shell layer binder resin particle dispersion liquid (1) is gently added to the mixed dispersion liquid, and the resultant mixture is kept at 45° C. for 120 minutes. The volume-average diameter of the resultant resin-adhered agglomerates is 6.2 μm as measured with COULTER COUNTER (TA2 MODEL manufactured by Coulter). The dispersion liquid, which is being stirred, is heated to 95° C. and kept at that temperature for 2 hours. Then, the dispersion liquid is cooled to 20° C. at a speed of 10° C./min and filtered, and the resultant particles collected are washed with deionized water and dried in a vacuum dryer to obtain toner mother particles (4).

The toner mother particles (4) have a volume-average diameter of 6.3 μm as measured with COULTER COUNTER (TA2 MODEL manufactured by Coulter).

Various characteristic values of the binder resins used for preparation of respective toner mother particles and those of the toner mother particles are respectively summarized in Tables 1 and 2.

TABLE 2-continued

| | Storage modulus at 60° C. (Pa) | Ratio of storage modulus at 60° C. to that at 80° C.: G'(60)/G'(80) | Number of Tangent loss peaks in range of 30 to 90° C. |
|---|---|---|---|
| Toner mother particles (3) | $5.3 \times 10^7$ | 135.0 | 1 |
| Toner mother particles (4) | $2.1 \times 10^5$ | 55.9 | 1 |

Preparation of Carrier

Ferrite particles (volume-average diameter: 50 μm) 100 parts by mass

Toluene 14 parts by mass

Styrene-methyl methacrylate copolymer [monomer ratio (weight ratio) of styrene/methyl methacrylate of 90/10; weight-average molecular weight Mw of 80,000] 2 parts by mass Carbon black (R330 manufactured by Cabot) 0.2 parts by mass First, the above components other than ferrite particles are mixed with a stirrer for 10 minutes to obtain a coating dispersion liquid. The coating dispersion liquid and the ferrite particles are placed in a vacuum-deaeration kneader and stirred with the kneader at 60° C. for 30 minutes. Thereafter, the resultant mixture, which is being heated, is deaerated and dried under a reduced pressure to obtain a carrier.

Preparation of Developer 1.2 parts by mass of commercially available fumed silica RX50 (manufactured by Nippon Aerosil Co., Ltd.) serving as an external additive is added to 100 parts by mass of each of the toner mother particles (1) to (4), and the resultant mixture is stirred with a Henschel mixer to obtain each of toners (1) to (4).

Then, 5 parts by mass of each of these toners is blended with 100 parts by mass of the carrier to obtain two-component developers (1) to (4).

TABLE 1

| | Storage modulus of core layer binder resin at 80° C. (Pa) | Storage modulus of shell layer binder resin at 80° C. (Pa) | Ratio of storage modulus of core layer binder resin to that of shell layer binder resin at 80° C. | Difference in SP value between core layer and shell layer binder resins (ΔSP) |
|---|---|---|---|---|
| Toner mother particles (1) | $3.58 \times 10^4$ | $4.49 \times 10^5$ | 12.5 | 0.57 |
| Toner mother particles (2) | $2.23 \times 10^4$ | $4.49 \times 10^5$ | 20.1 | — |
| Toner mother particles (3) | $3.58 \times 10^4$ | $5.68 \times 10^8$ | $1.58 \times 10^4$ | 0.17 |
| Toner mother particles (4) | $2.41 \times 10^2$ | $4.49 \times 10^5$ | $1.83 \times 10^3$ | 1.16 |

TABLE 2

| | Storage modulus at 60° C. (Pa) | Ratio of storage modulus at 60° C. to that at 80° C.: G'(60)/G'(80) | Number of Tangent loss peaks in range of 30 to 90° C. |
|---|---|---|---|
| Toner mother particles (1) | $2.5 \times 10^6$ | 18.0 | 2 |
| Toner mother particles (2) | $8.7 \times 10^5$ | 28.2 | 2 |

Viscoelasticity Measurement

A storage modulus is determined from the dynamic viscoelasticity measured in accordance with a sine wave oscillation method. ARES measuring device manufactured by Rheometric Scientific Inc. is used to measure the dynamic viscoelasticity. The dynamic viscoelasticity is measured as follows. A toner formed into a tablet is placed between parallel plates having a diameter of 8 mm. After normal force is set to zero in the measuring device, sine wave vibrations are applied to the tablet at a vibration frequency of 6.28 rad/sec. The measurement is performed while the tablet is heated from 20° C. to 100° C. at a programming rate of 1° C./min. The measurement time interval is 30 seconds.

While the amount of stress applied to the toner is changed, the distortion factor of the toner is measured in the temperature range of from 20° C. to 100° C. at an interval of 10° C. Thereby, the relationship therebetween is obtained and the range of distortion factor where the amount of stress and the distortion factor have a linear relationship is determined at each temperature before measurement. In the measurement, the distortion factor at each measurement temperature is kept at 0.1% and the amount of stress and the distortion factor are so controlled as to have a linear relationship over the entire temperature range. The storage modulus and the tangent loss are calculated from the measurement results obtained.

Volume-average Diameter

COULTER COUNTER TA-2 (manufactured by Beckmann Coulter) is used to measure the volume-average diameter of the toner particles, and ISOTON-II (manufactured by Beckmann Coulter) is used as an electrolyte.

First, a measurement sample is added to 2 ml of an aqueous solution containing a surfactant (dispersant), preferably a sodium alkylbenzenesulfonate, and having a content of 5 wt %. The amount of the measurement sample is 0.5 to 50 mg. The mixture is then added to 100 ml of the electrolyte to prepare a sample.

Then, the sample-suspended electrolyte is stirred with an ultrasonic dispersing machine for about 1 minute, and the particle diameter distribution of particles in the range of 2.0 to 50.8 μm is obtained with an aperture having an aperture diameter of 100 μm and COULTER COUNTER TA-II model, and the volume average distribution and the number average distribution are determined.

A cumulative distribution curve is drawn from the smallest side, by using the volumes of toner particles classified according to grain ranges (channel) obtained by dividing the whole range of the measured toner particles, and the particle diameter at a cumulative count of 50% is regarded as the volume-average diameter (D50v).

Molecular Weight

The molecular weight of each of the binder resins is determined under the following conditions. The GPC device used is HLC-8120GPC or SC-8020 (manufactured by Tosoh Corp.), the columns used are TSK gel and SuperHM-H (manufactured by Tosoh Corp., and having an internal diameter of 6.0 mm and a length of 15 cm), and the eluent is tetrahydrofuran (THF). As for experimental conditions, the sample concentration is 0.5%, the flow rate is 0.6 ml/min, the sample injection amount is 10 μl, and the measurement temperature is 40° C. An IR detector is also used for the measurement. In preparing the calibration curve, ten samples of polystyrene standard samples TSK Standard manufactured by Tosoh Corp are used: "A-500", "F-1", "F-10", "F-80", "F-380", "A-2500", "F-4", "F-40" "F-128", and "F-700".

Preparation of Unfixed Halftone Image

An unfixed halftone image is formed with a test machine obtained by remodeling a printer, DocuCentreColor500® manufactured by Fuji Xerox. Specifically, a halftone image having a cyan toner layer, an area rate of 50% and a size of 25 mm×25 mm is formed on recording paper (J paper manufactured by Fuji Xerox) at a toner load amount of 4.8 g/m$^2$ by using each of the toners (developers).

Here, laser beams irradiated onto the latent image-holding member according to latent image information have diameters of 21 μm, 42 μm, and 84 μm. In addition, an input signal corresponding to image information is transformed into an output signal by using two pseudo-halftone processing methods: AM screening using a dither method and FM screening using an error diffusion method.

The dot structure (the size and arrangement of toner aggregates) of the output unfixed image is observed with an ultra-depth color 3D shape measuring microscope, VK-9500 manufactured by KEYENCE Corporation. As a result, it is confirmed that the unfixed halftone image obtained by the AM screening has a dot structure in which toner aggregates having a uniform size and corresponding to dots, which are separate from each other, are aligned at a certain period. On the other hand, in the unfixed halftone image obtained by the FM screening, it is confirmed that the dot density changes specially, that the dots are not aligned at a certain period, that the dot size changes according to the beam diameter, and that toner aggregates having uneven sizes and irregular arrangement are formed.

Evaluation of Fixing Property

A test machine obtained by remodeling a printer, DocuCentreColor500® manufactured by Fuji Xerox, is used for evaluation of fixing property of a toner. The machine, which contains a 900W halogen lamp as a heater for heating a nip portion in the heating roll of the fixing unit, allows variable control of the set fixing temperature of the fixing unit in the range of 70° C. to 200° C.

In addition, the machine has a function for saving power during stand-by periods. Therefore, when the set fixing temperature of the fixing unit is adjusted at 110° C., the temperature of the fixing unit is kept at 105° C. during stand-by periods.

Warm-up time depends on the set fixing temperature. However, when the set fixing temperature of the fixing unit is within the range of 70° C. to 200° C., the warm-up time is approximately 5 to approximately 15 seconds. The warm-up time is a period from the end of stand-by period to a time when image formation has become possible, and practically a period which is required by change of the actual temperature of the fixing unit from the temperature at the time of standing by to the set fixing temperature.

The fixing property of the toner is evaluated as follows. Unfixed images are prepared in advance according to each combination of the toner, the screen processing, and the beam diameter shown in Table 3. Thereafter, the fixing unit is left in the stand-by mode for sufficient time to make the temperature thereof constant. Then, the device is made to be in the print mode, and 30 halftone images prepared under the same conditions are successively fixed at a predetermined fixing temperature. The above procedure is repeated, while the set fixing temperature of the fixing unit is changed in the range of 70° C. to 200° C.

The lowest fixing temperature, halftone offsetting (HOT) property, and image graininess are evaluated and summarized in Table 3.

TABLE 3

| | Kind of toner | Pseudo-halftone processing | Beam diameter (μm) | Lowest fixing temperature (° C.) | Low-temperature fixing property evaluation | HOT (° C.) | Difference between HOT and lowest fixing temperature (° C.) | Fixing property evaluation | Graininess |
|---|---|---|---|---|---|---|---|---|---|
| Example 1 | Toner (1) | FM | 42 | 100 | B | 155 | 55 | A | A |
| Example 2 | Toner (2) | FM | 42 | 95 | A | 155 | 60 | A | A |
| Comparative Example 1 | Toner (4) | AM | 21 | 100 | B | 115 | 15 | C | A |
| Example 3 | Toner (1) | FM | 84 | 100 | B | 165 | 65 | A | C |
| Comparative Example 2 | Toner (1) | FM | 21 | 100 | B | 125 | 25 | C | A |
| Comparative Example 3 | Toner (1) | AM | 42 | 100 | B | 125 | 25 | C | A |
| Comparative Example 4 | Toner (3) | FM | 42 | 140 | D | 200 | 60 | A | A |
| Comparative Example 5 | Toner (4) | FM | 42 | 90 | A | 100 | 10 | C | A |

Methods of evaluating the lowest fixing temperature, halftone offsetting (HOT) property, and image graininess in Table 3 and evaluation criteria are as follows.

Lowest Fixing Temperature

A visual check was made to determine whether offsetting occurs in each of the images fixed at a fixing temperature in the range of 70° C. to 200° C. The lowest fixing temperature at which offsetting occurs in none of the 30 fixed images is determined. The criteria for evaluation of the lowest fixing temperature are as follows.

A: The lowest fixing temperature is 100° C. or less.

B: The lowest fixing temperature is higher than 100° C. and lower than 110° C.

C: The lowest fixing temperature is not lower than 110 and lower than 120° C.

D: The lowest fixing temperature is 120° C. or higher.

Halftone Offsetting Property, Fixing Property

The highest fixing temperature at which offsetting occurs in none of the 30 fixed images is designated as a halftone offsetting temperature. The fixing property of the toner is evaluated on the basis of the difference between the halftone offsetting temperature and the lowest fixing temperature. The evaluation criteria are as follows.

A: The difference is 40° C. or more.

B: The difference is not less than 30° C. and less than 40° C.

C: The difference is less than 30° C.

Graininess

The graininess of the halftone image fixed is visually checked and evaluated according to the following criteria.

A: The image has no rough surface.

B: The image has a slightly rough surface.

C: The image has a significantly rough surface.

The image evaluated as "A" is at an acceptable level, and that evaluated as "B" or "C" is at an unacceptable level.

Evaluation Results

As is apparent from Table 3, each of Examples 1 to 3, in which a toner satisfying Formulae (1) and (2) is used, allows low-temperature fixing. In addition, because FM screening is used as the pseudo-halftone processing and the diameter of each of the beams irradiated onto the latent image-holding member according to image information is controlled to 35 μm or more, the halftone offsetting temperature is sufficiently high. As shown in Examples 1 and 2, making the beam diameter 42 μm can improve graininess.

However, Comparative Example 1, in which a toner not satisfying Formulae (1) and (2) is used, in which AM screening is used as the pseudo-halftone processing, and in which the beam diameter is less than 35 μm, does not allow low-temperature fixing and shows a low halftone offsetting temperature.

Comparative Example 2, in which a toner satisfying Formulae (1) and (2) is used, allows low-temperature fixing. However, the beam diameter is less than 35 μm in Comparative Example 2. Therefore, halftone-offsetting temperature is low regardless of FM screening being conducted. The reason for this is thought to be as follows. Since the latent dots which are formed by laser irradiation and of which an electrostatic latent image is composed are small, there are few areas where latent dots adjoin or overlap with each other. Consequently, the toner aggregates formed corresponding to the latent dots tend to have a uniform and small size.

Comparative Example 3, in which a toner satisfying Formulae (1) and (2) is used, allows low-temperature fixing. However, because AM screening is used as the pseudo-halftone processing, there is no area where latent dots adjoin or overlap with each other, and the size of the toner aggregates becomes uniform, and the halftone offsetting temperature is low.

In Comparative Example 4, FM screening is used and the beam diameter is controlled to 35 μm or more. However, because the toner used does not satisfy Formulae (1) and (2), Comparative Example 4 does not allow low-temperature fixing.

In Comparative Example 5, FM screening is used and the beam diameter is controlled to 35 μm or more. However, the toner used does satisfy Formula (1) but does not satisfy Formula (2). As a result, Comparative Example 5 allows low-temperature fixation, but the halftone offsetting temperature is extremely low.

What is claimed is:

1. An image-forming method, comprising:

pseudo-halftone-processing an input signal corresponding to image information to generate an output signal;

irradiating a radiation beam corresponding to the output signal onto the surface of a latent image-holding member to form a latent image;

developing the latent image with a developer including a toner containing a binder resin and a colorant to form a toner image on the surface of the latent image-holding member;

transferring the toner image onto a recording medium; and fixing the toner image on the recording medium to form an image, wherein:

when a halftone image is formed as the image, the toner image formed on the surface of the latent image-holding member by the pseudo-halftone processing is composed of a plurality of toner aggregates scattered like dots on the surface of the latent image-holding member; the diameter of the radiation beam irradiated onto the surface of the latent image-holding member is 35 μm or more; the pseudo-halftone processing results in the toner aggregates, which have been transferred onto the recording medium, having uneven sizes; and the toner satisfies the following Formulae (1) and (2):

$$2.0\times10^5 \leqq G'(60) \leqq 4.0\times10^6 \quad \text{Formula (1)}$$

$$G'(60)/G'(80) \leqq 40 \quad \text{Formula (2)}$$

wherein in Formulae (1) and (2), G'(60) represents the storage modulus (Pa) of the toner as determined under conditions of a temperature of 60° C., a vibration frequency of 6.28 rad/sec, and a distortion factor of 0.1%; and G'(80) represents the storage modulus (Pa) of the toner as determined under conditions of a temperature of 80° C., a vibration frequency of 6.28 rad/sec, and a distortion factor of 0.1%.

2. The image-forming method of claim 1, wherein transferring the toner image further comprises transferring the toner image formed on the surface of the latent image-holding member onto the surface of an intermediate transfer member and transferring the toner image transferred on the surface of the intermediate transfer member to the surface of the recording medium.

3. The image-forming method of claim 1, wherein the toner is prepared by:

adding a coagulant to a mixed dispersion liquid containing a first resin fine particle dispersion liquid containing first resin fine particles of a first binder resin having a volume average diameter of 1 μm or less and a colorant dispersion liquid containing colorant particles, and heating the resulting mixture to form a dispersion liquid containing core particles;

adding a second resin fine particle dispersion liquid containing second resin fine particles of a second binder resin having a volume average diameter of 1 μm or less to the dispersion liquid containing the core particles and adhering the second resin fine particles onto the surfaces of the core particles to form resin-adhered agglomerates; and fusing the resin-adhered agglomerates.

4. The image-forming method of claim 1, wherein the toner has a difference between the solubility parameter of a first binder resin (SPc) and that of a second binder resin (SPs), ($\Delta SP=|SPc-SPs|$), of 0.2 to 0.6.

5. The image-forming method of claim 1, wherein the toner further comprises a releasing agent.

6. The image-forming method of claim 1, wherein the toner further comprises an external additive.

7. The image-forming method of claim 6, wherein the external additive is metatitanic acid.

8. The image-forming method of claim 7, wherein the metatitanic acid is hydrophobilized and has an electric resistance of $10^{10}$ Ω·cm or more.

9. The image-forming method of claim 6, wherein the amount of the external additive added is 0.3 to 3 parts by mass with respect to 100 parts by mass of toner particles.

10. A device for forming an image, comprising:

a latent image-holding member;

a pseudo-halftone processor for pseudo-halftone-processing an input signal corresponding to image information to generate an output signal;

a latent image-forming unit for irradiating a radiation beam corresponding to the output signal to form a latent image on the surface of the latent image-holding member;

a developing unit for developing the latent image with a developer including a toner containing a binder resin and a colorant to form a toner image on the surface of the latent image-holding member;

a transfer unit for transferring the toner image onto a recording medium; and a fixing unit for fixing the toner image on the recording medium to form an image, wherein the image is formed by the image-forming method according to claim 1, and, when a halftone image is formed as the image, the toner image formed on the surface of the latent image-holding member by the pseudo-halftone processing is composed of a plurality of toner aggregates scattered like dots on the surface of the latent image-holding member.

* * * * *